US009016821B2

(12) United States Patent
Masuda et al.

(10) Patent No.: US 9,016,821 B2
(45) Date of Patent: Apr. 28, 2015

(54) IMAGE PROCESSING APPARATUS AND IMAGE PROCESSING METHOD

(75) Inventors: Satoshi Masuda, Yokohama (JP); Tomoki Yamamuro, Kawasaki (JP); Hitoshi Nishikori, Inagi (JP); Osamu Iwasaki, Tokyo (JP); Norihiro Kawatoko, Yokohama (JP); Atsuhiko Masuyama, Yokohama (JP); Fumiko Suzuki, Kawasaki (JP); Nobuhiro Kitabatake, Kawasaki (JP); Mitsuhiro Ono, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/459,822

(22) Filed: Apr. 30, 2012

(65) Prior Publication Data

US 2012/0287194 A1 Nov. 15, 2012

(30) Foreign Application Priority Data

May 10, 2011 (JP) ..... 2011-105240
Mar. 26, 2012 (JP) ..... 2012-068973
Apr. 26, 2012 (JP) ..... 2012-101527

(51) Int. Cl.
*B41J 2/195* (2006.01)
*B41J 2/155* (2006.01)

(52) U.S. Cl.
CPC . *B41J 2/195* (2013.01); *B41J 2/155* (2013.01)

(58) Field of Classification Search
CPC ..... B41J 2/00; B41J 2/155; B41J 2/195; B41J 2/04501
USPC ..... 347/7, 14, 15
See application file for complete search history.

(56) References Cited

U.S. PATENT DOCUMENTS

| | | | | |
|---|---|---|---|---|
| 6,120,129 | A | 9/2000 | Iwasaki et al. | |
| 6,244,681 | B1 | 6/2001 | Yano et al. | |
| 6,260,938 | B1 * | 7/2001 | Ohtsuka et al. | 347/15 |
| 6,439,683 | B1 * | 8/2002 | Matsumoto et al. | 347/15 |
| 6,543,872 | B2 | 4/2003 | Ohtsuka et al. | |
| 6,601,938 | B1 | 8/2003 | Iwasaki et al. | |
| 2006/0215192 | A1 * | 9/2006 | Nagahara et al. | 358/1.9 |

FOREIGN PATENT DOCUMENTS

| | | | |
|---|---|---|---|
| JP | 11-320864 | A | 11/1999 |
| JP | 2002-326347 | A | 12/2002 |

OTHER PUBLICATIONS

U.S. Appl. No. 13/459,919, filed Apr. 30, 2012, Hitoshi Nishikori et al.
U.S. Appl. No. 12/870,650, filed Aug. 27, 2010, Kentaro Yano et al.

* cited by examiner

*Primary Examiner* — Sarah Al Hashimi
(74) *Attorney, Agent, or Firm* — Fitpatrick, Cella, Harper & Scinto

(57) ABSTRACT

Adequate correction processing is performed on image data based on the degree of ink concentration that occurs even. An image processing apparatus having: acquisition unit for acquiring multi-value image data and a first parameter related to the degree of concentration of ink; first generation unit for generating corrected data by correcting the multi-value data that is to be printed for the first pixel based on the multi-value data that is to printed in the first pixel and a first parameter; and second generation unit for generating the first parameter and a second parameter that indicates the degree of ink concentration of the plurality of nozzles when printing a second pixel that is printed by the nozzles next to the first pixel.

22 Claims, 30 Drawing Sheets

| threshold | Out | Evaluation |
|---|---|---|
| 255 | | |
| | Level4 | 255 |
| 224 | | |
| | Level3 | 192 |
| 160 | | |
| | Level2 | 128 |
| 96 | | |
| | Level1 | 64 |
| 32 | | |
| | Level0 | 0 |
| 0 | | |

Level 1

Level 2

Level 3

Level 4

INK DATA

AVERAGE INTEGRATED VALUE

| | 0 | ··· | 64 | |
|---|---|---|---|---|
| 0 | 10 | | 0 | |
| ⋮ | ⋮ | | ⋮ | |
| 1200 | 10 | | -115 | |
| ⋮ | ⋮ | | ⋮ | |

600dpi

| | | | | | | | |
|---|---|---|---|---|---|---|---|
| 64 | 64 | 64 | 64 | 64 | 64 | 64 | 64 |
| 64 | 64 | 64 | 64 | 64 | 64 | 64 | 64 |
| 64 | 64 | 64 | 64 | 64 | 64 | 64 | 64 |

| INK DATA | AVERAGE INTEGRATED VALUE 1100 | 1200 | 1300 | 1400 | |
|---|---|---|---|---|---|
| ⋮ | ⋮ | ⋮ | ⋮ | ⋮ | ⋮ |
| 64 | 0 | -1 | -2 | -3 | -4 |
| ⋮ | ⋮ | ⋮ | ⋮ | ⋮ | ⋮ |
| 66 | 0 | -1 | -2 | -3 | -4 |
| ⋮ | ⋮ | ⋮ | ⋮ | ⋮ | ⋮ |

| | | | | | | | | | |
|---|---|---|---|---|---|---|---|---|---|
| FIRST INTEGRATED VALUE CONTROL | 0 | 10 | 20 | ··· | 1200 | 1210 | ··· | 1280 | 0 |
| FIRST EJECTION NUMBER CONTROL | 8 | 8 | 8 | ··· | 7 | 6 | ··· | 0 | 0 |
| SECOND INTEGRATED VALUE CONTROL | 0 | 0 | 0 | ··· | 200 | 205 | ··· | 230 | 240 |
| SECOND EJECTION NUMBER CONTROL | 0 | 0 | 0 | ··· | 1 | 2 | ··· | 8 | 7 |
| THIRD INTEGRATED VALUE CONTROL | 0 | 0 | 0 | ··· | 0 | 0 | ··· | 0 | 10 |
| THIRD EJECTION NUMBER CONTROL | 0 | 0 | 0 | ··· | 0 | 0 | ··· | 0 | 1 |

FIG.21A

| | CHANGE AMOUNT TABLE | CORRECTION TABLE |
|---|---|---|
| Tblset_a01 | Yosoku_table_a0001 | Hosei_table_a0001 |
| Tblset_a02 | Yosoku_table_a0002 | Hosei_table_a0001 |

FIG.21B

| | CHANGE AMOUNT TABLE | CORRECTION TABLE |
|---|---|---|
| NON-EJECTION INTERPOLATION PROCESS IS PERFORMED | Yosoku_table_c0001 | Hosei_table_c0001 |
| NON-EJECTION INTERPOLATION PROCESS IS NOT PERFORMED | Yosoku_table_c0003 | Hosei_table_c0001 |

FIG.21C

| | CHANGE AMOUNT TABLE | CORRECTION TABLE |
|---|---|---|
| ⋮ | ⋮ | ⋮ |
| NOZZLE DIAMETER ERROR:-5% | Yosoku_table_d1005 | Hosei_table_d0000 |
| NOZZLE DIAMETER ERROR:-4% | Yosoku_table_d1004 | Hosei_table_d0000 |
| NOZZLE DIAMETER ERROR:-3% | Yosoku_table_d1003 | Hosei_table_d0000 |
| NOZZLE DIAMETER ERROR:-2% | Yosoku_table_d1002 | Hosei_table_d0000 |
| NOZZLE DIAMETER ERROR:-1% | Yosoku_table_d1001 | Hosei_table_d0000 |
| NOZZLE DIAMETER ERROR: 0% | Yosoku_table_d0000 | Hosei_table_d0000 |
| NOZZLE DIAMETER ERROR:+1% | Yosoku_table_d0001 | Hosei_table_d0000 |
| NOZZLE DIAMETER ERROR:+2% | Yosoku_table_d0002 | Hosei_table_d0000 |
| NOZZLE DIAMETER ERROR:+3% | Yosoku_table_d0003 | Hosei_table_d0000 |
| NOZZLE DIAMETER ERROR:+4% | Yosoku_table_d0004 | Hosei_table_d0000 |
| NOZZLE DIAMETER ERROR:+5% | Yosoku_table_d0005 | Hosei_table_d0000 |
| ⋮ | ⋮ | ⋮ |

FIG.21D

| | CHANGE AMOUNT TABLE | CORRECTION TABLE |
|---|---|---|
| ⋮ | ⋮ | ⋮ |
| LARGE : SMALL=52:48 | Yosoku_table_e5248 | Hosei_table_e5248 |
| LARGE : SMALL=51:49 | Yosoku_table_e5149 | Hosei_table_e5149 |
| LARGE : SMALL=50:50 | Yosoku_table_e5050 | Hosei_table_e5050 |
| LARGE : SMALL=49:51 | Yosoku_table_e4951 | Hosei_table_e4951 |
| LARGE : SMALL=48:52 | Yosoku_table_e4852 | Hosei_table_e4852 |
| ⋮ | ⋮ | ⋮ |

| | SMALL NOZZLES | LARGE NOZZLES |
|---|---|---|
| DESIGN VALUE FOR EJECTION AMOUNT | 5.0 | 7.0 |
| ACTUAL EJECTION AMOUNT | 5.2 | 7.2 |
| USAGE RATIO | 60% | 40% |
| AVERAGE EJECTION AMOUNT WITH NO ADJUSTMENT OF USAGE RATIO OF LARGE AND SMALL NOZZLES (LARGE : SMALL = 50 : 50) | 6.2 | |
| AVERAGE EJECTION AMOUNT AFTER ADJUSTMENT OF USAGE RATIO OF LARGE AND SMALL NOZZLES | 6.00 | |

FIG.26

IMAGE PROCESSING APPARATUS AND IMAGE PROCESSING METHOD

BACKGROUND OF THE INVENTION

1. Field of the Invention

The present invention relates to an image processing apparatus and image processing method, and more particularly to an image processing apparatus and image processing method that perform correction of density unevenness of ink.

2. Description of the Related Art

In an inkjet printing apparatus, characters or images are printed by ejecting ink drops onto a printing medium from nozzles that are provided in a printing head. In a state where ink drops are not ejected onto a printing medium, the moisture content of the ink in the nozzle evaporates over time, and the ink becomes concentrated. When ejecting concentrated ink onto a printing medium, dots having a thick density are formed.

The ink concentration often occurs near the ejection port of the nozzles, and when ink is ejected several times from the nozzles, ink is supplied from the ink tank that is not concentrated, and the density returns to the normal ink density. In the case of printing an image having uniform density using ink with this kind of concentration characteristics, when the ink is still concentrated, printing is performed with concentrated ink for a short time after printing starts. Therefore, the image on the end section where printing was started becomes dense, and uneven density occurs.

In order to suppress uneven density due to this kind of concentrated ink, technology is known wherein the change in density is estimated from the continuous amount of time that the nozzle has not been used for printing, and the density is kept fixed by determining the combination with ink having a different density than that used for printing (for example, refer to Japanese Patent Laid-Open No. H11-320864 (1999)).

Moreover, technology is known wherein printing is performed by correcting the density signal by a correction amount according to the amount of time that printing has not been performed (for example, refer to Japanese Patent Laid-Open No. 2002-326347).

However, in the technology that is disclosed in Japanese Patent Laid-Open No. H11-320864 (1999), the dot arrangement is set from the ink density signal for the printing image data, and for each dot, which nozzle of which nozzle array will be used to form the dot, is specified. After the nozzles for forming the dots have been specified, the change in density is estimated for each nozzle by checking the number of times the nozzle has not been used continuously for printing. Therefore, it is necessary to set a combination with ink having a different density, and repeatedly set the dot arrangement, the processing of which takes time.

Moreover, when performing printing using the technology disclosed in Japanese Patent Laid-Open No. 2002-326347, the density is corrected for the value of ink density signal before the dot arrangement is set. Therefore, in the areas for which density correction is performed, the number of dots formed changes. In order to estimate the change in density with maximum accuracy, it is necessary, after the ink density signal value has been corrected, to set the dot arrangement again and correct the density signal by a correction amount according to the amount of time that continuous printing has not been performed. Therefore, it is necessary to repeatedly correct the ink density signal value and set the dot arrangement, which processing takes time.

Furthermore, in the patent literatures above, the change in ink density is estimated from the amount of time that ink is not ejected, so that even when only one drop of ink is ejected, the time is reset. However, the concentration of ink proceeds the longer that ink is not ejected, so that when only one drop of ink is ejected, the concentration may not be recovered. In a form such as in the patent literatures above where the time is reset when one drop of ink is ejected, there is a problem in that the time is reset without the ink concentration being recovered, so correction may not be performed adequately.

Taking the above situation into consideration, the object of the present invention is to provide an image processing apparatus that suitably performs correction of image data based on the amount of ink concentration, even when the ink around a nozzle becomes concentrated due to ink not being ejected from the nozzle.

SUMMARY OF THE INVENTION

The present invention has been made in view of the above points and has an objective to provide an image processing apparatus that suitably performs correction of image data based on the amount of ink concentration, even when the ink around a nozzle becomes concentrated due to ink not being ejected from the nozzle.

In order to accomplish that, the present invention is an image processing apparatus for a printing apparatus that prints images on a printing medium by relative scanning of a printing head comprising a plurality of nozzles that eject the same color of ink over a printing medium; comprising: acquisition means for acquiring multi-value image data that is to be printed in a first pixel on the printing medium, and a first parameter related to the degree of concentration of ink when a plurality of nozzles from among the nozzles included in a plurality of nozzle arrays that can eject the ink to (the first pixel print the first pixel; first generation means for generating corrected data by correcting the multi-value data that is to be printed for the first pixel based on the multi-value data that is to printed in the first pixel and a first parameter; and second generation means for generating the first parameter and a second parameter that indicates the degree of ink concentration of the plurality of nozzles when printing a second pixel that is printed next to the first pixel by the nozzles that can eject the ink to the first pixel.

Further features of the present invention will become apparent from the following description of exemplary embodiments (with reference to the attached drawings).

BRIEF DESCRIPTION OF THE DRAWINGS

FIG. 21A to FIG. 21D are schematic diagrams illustrating selection tables of a fourth through eighth embodiment;

FIG. 26 is a table illustrating combinations of usage ratios of a seventh embodiment;

DESCRIPTION OF THE EMBODIMENTS

In the following, embodiments of the present invention will be explained in detail with reference to the drawings.

Embodiment 1

Figure 1:
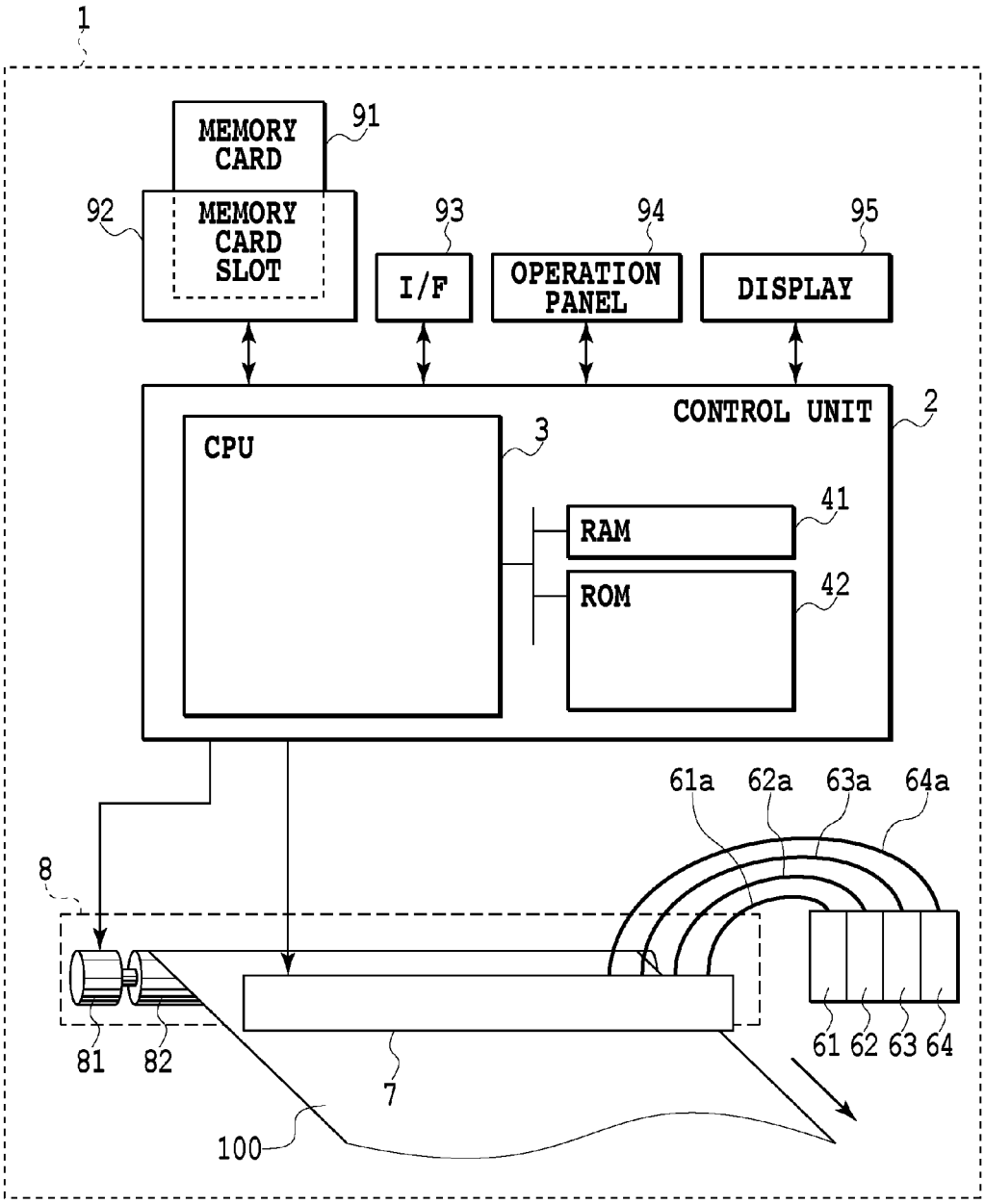
FIG. 1 is an explanative drawing illustrating an inkjet printing apparatus of a first embodiment.

FIG. 1 is an explanative drawing illustrating an inkjet printing apparatus of an embodiment of the present invention. The inkjet printing apparatus 1 of this embodiment is a line printer and comprises a control unit 2, ink cartridges 61, 62, 63, 64, a printing head 7 and a printing medium conveying mechanism 8. Ink that expresses the colors cyan, magenta, yellow and black is stored in the ink cartridges.

The printing head 7 is a line type printing head, and comprises a plurality of thermal nozzles that are arranged in a direction that is orthogonal to the conveying direction of the printing medium. The ink that is stored in the ink cartridges 61 to 64 is supplied to the nozzles that are provided in the printing head through respective ink introduction tubes 61*a*, 62*a*, 63*a*, 64*a*. The ink is then ejected from these nozzles to form an image on the printing medium 100.

The printing medium conveying mechanism 8 comprises a sheet conveying motor 81 and sheet conveying roller 82. The sheet conveying motor 81 rotates the sheet conveying roller 82, which then conveys the printing medium 100 to the position of the printing head 7.

The control unit 2 comprises a CPU 3, a RAM 41 and a ROM 42, and controls the operation of the printing head 7 and sheet conveying roller 81. The CPU 3 expands a control program that is stored ROM 42 in RAM 41, and by executing the control program, performs various processes related to the image that will be described later, generates image data to be printed by the printing head 7, controls the printing medium conveying mechanism 8 and the like.

Figure 2:
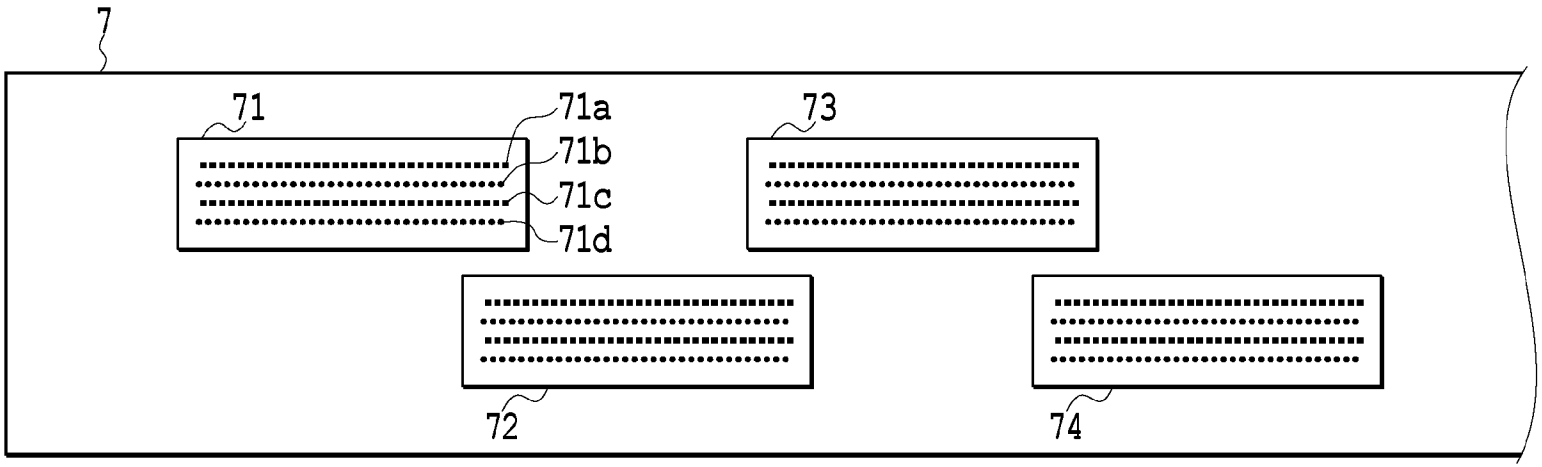
FIG. 2 is an outline drawing illustrating a printing head of a first embodiment.

FIG. 2 is a drawing illustrating the printing head. In FIG. 2, one of the four colors cyan, magenta, yellow and black is illustrated. The printing head 7 is formed such that ejection substrates 71, 72, 73 and 74, on which nozzle arrays 71*a*, 71*b*, 71*c* and 71*d* that eject ink are arranged, are aligned in a zigzag manner. Ink drops of the same color are ejected from these ejection substrates, and by adjusting the conveyance of the printing medium and the ejection timing of the ink, ink is ejected onto the printing medium and an image can be formed. The ejection substrates of this embodiment are arranged in a zigzag manner; however, the ejection substrates of the present invention can also be arranged in a straight line.

The printing apparatus of this embodiment uses a thermal printing head; however, the present invention is not limited to this. Any printing head that is a line head and in which a plurality of ejection substrates are arranged along a direction that crosses the conveying direction, and can eject ink from a plurality of nozzles in the same line (raster) along the conveying direction in the printing area can be used. For example, other ink ejection type inkjet printing heads such as a piezo type head can be used. Moreover, it is also possible to include ink colors in addition to cyan, magenta, yellow and black, and it also possible to not include all of these colors.

Next, image processing of this embodiment will be explained.

Figure 3:
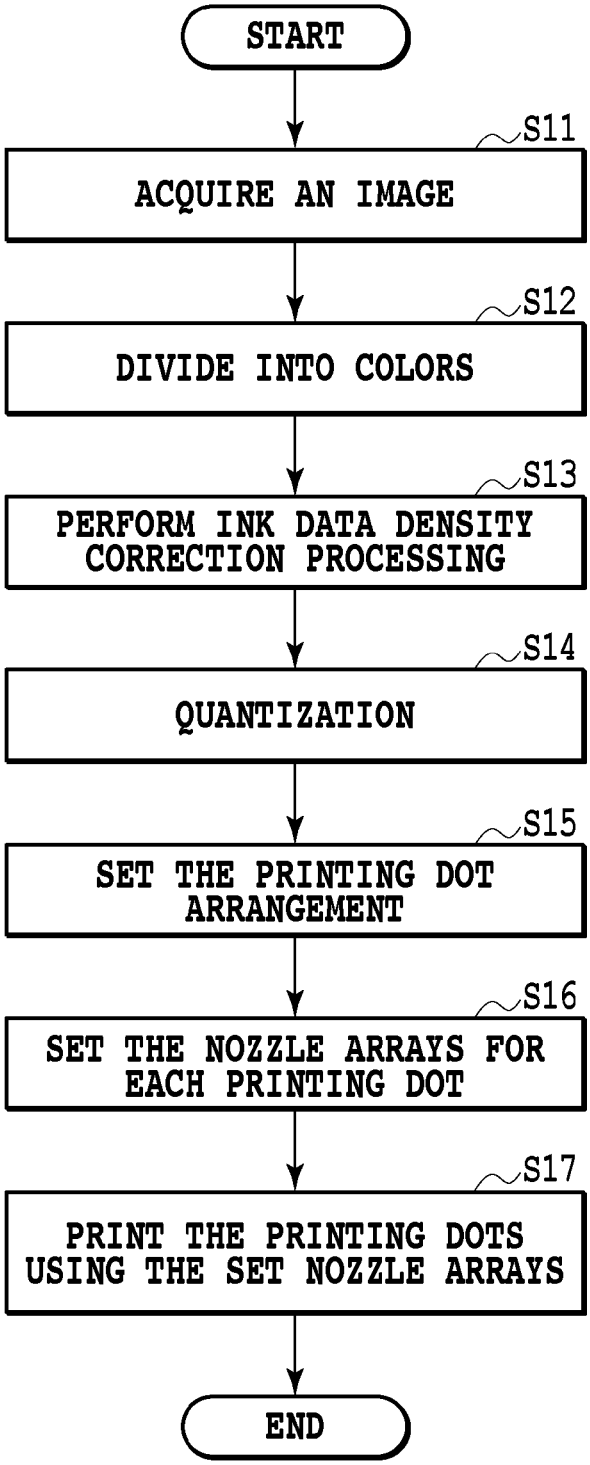
FIG. 3 is a flowchart illustrating image processing of a first embodiment.

FIG. 3 is a flowchart illustrating the flow of a process that, by performing specified image processing of image data that is stored in a memory card 91 of the printing apparatus 1, converts the image data to dot data that represents the image data by dots or no dots, and prints the image.

Figure 4:
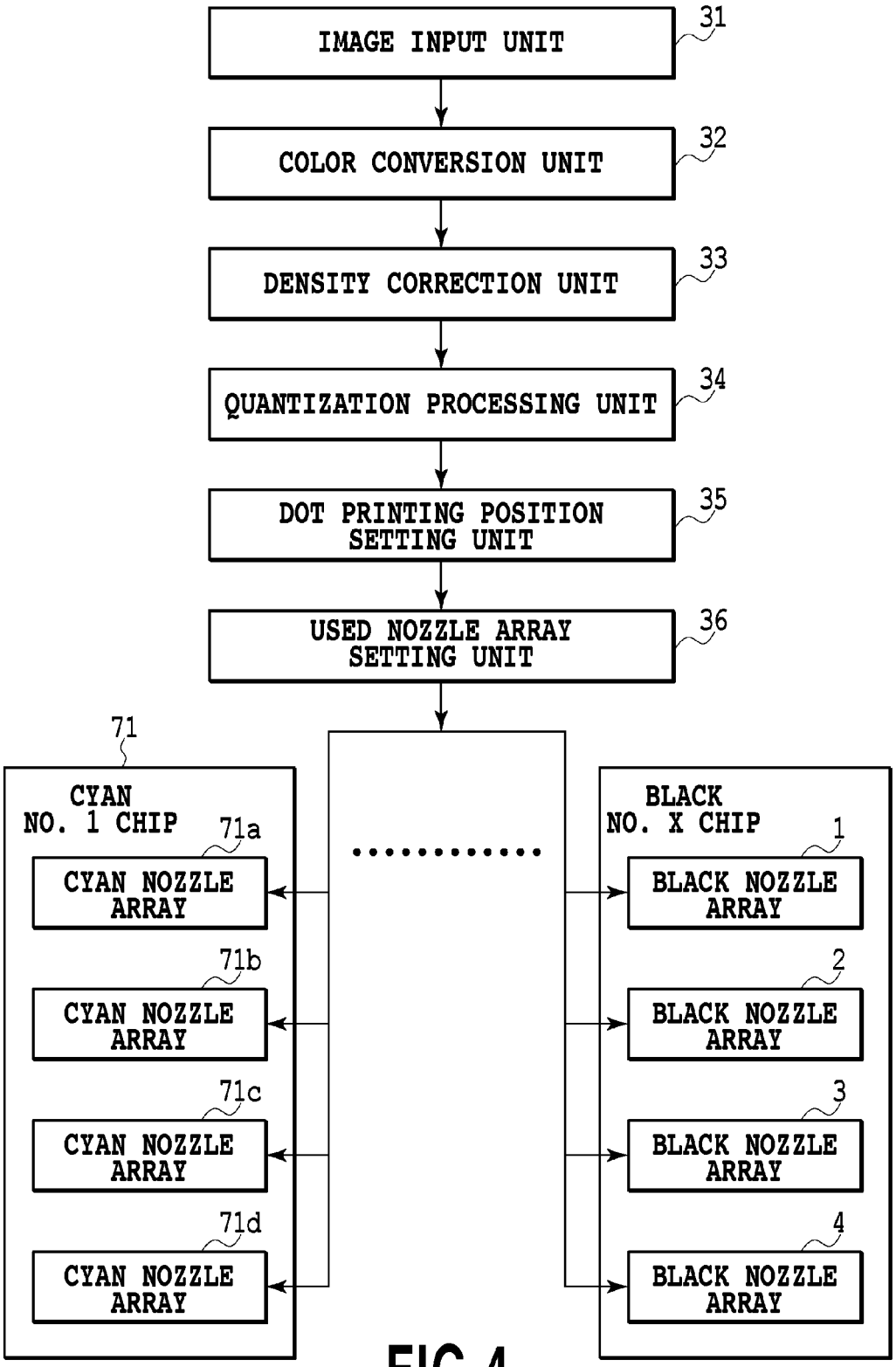
FIG. 4 is a block diagram illustrating image processing of a first embodiment.

FIG. 4 is a block diagram illustrating the image processing of this embodiment.

After the image processing starts, the control unit 2 uses an image input unit 31 to read the image data that is to be printed from the memory card 91 (step S11). The image data in this embodiment is 8-bit, 256-gradation, RGB color image data having a resolution of 600 dpi.

Next, a color conversion processing unit 32 performs color conversion and converts the image data to 600 dpi, 8-bit, 256-gradation CMYK color (step S12). The color conversion process is a process that converts RGB color image data that is expressed by a combination of R (red), G (green) and B (blue) gradation values to data that is expressed by gradation values of the ink colors used in printing. The printing apparatus 1 prints images using the four ink colors C (cyan), M (magenta), Y (yellow) and K (black). Therefore, the color conversion processing unit of this embodiment performs a process of converting image data expressed using RGB, to multi-value image data that is expressed by gradation values of the colors C, M, Y and K (hereafter, referred to as ink data).

Next, a density correction unit 33 performs an ink density correction process (hereafter, referred to as density correction) due to ink concentration, and corrects the ink data for each color (step S13). This density correction will be explained in detail later.

After the ink data density correction process has been performed, a quantization processing unit 34 performs quantization processing of the corrected ink data of each color (step S14). This quantization process is a process for reducing 8-bit, 256-gradation image data, which has a large number of gradations, to a suitable low gradation value that can be printed by the printing apparatus 1 (5 values in this embodiment). Typically, an error diffusion method or dithering method is used for this quantization process. In this embodiment, the error diffusion method will be used.

Figures 5A, 5B:
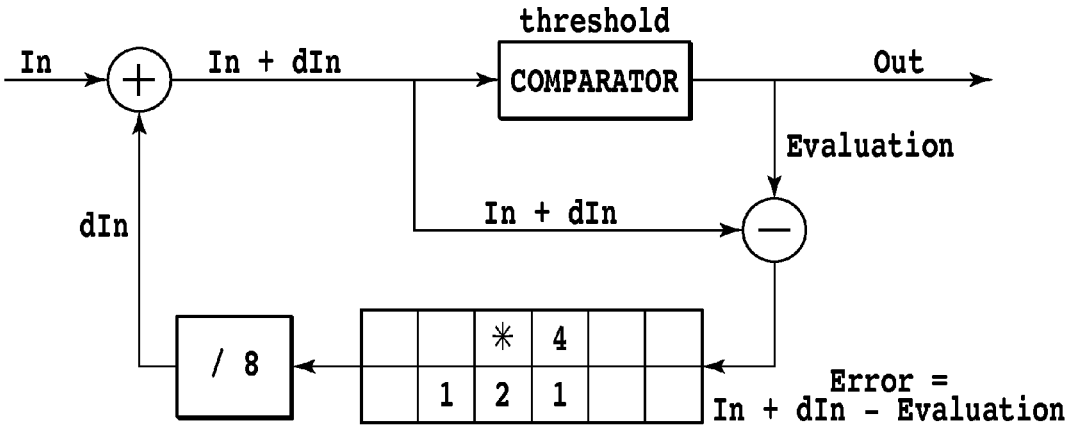
FIG. 5A and FIG. 5B are drawings for explaining error diffusion processing of a first embodiment.

FIG. 5A and FIG. 5B are diagrams for explaining the error diffusion process of this embodiment. FIG. 5A is a diagram illustrating the flow of the error diffusion process, and FIG. 5B is a table illustrating the relationship of a threshold value (threshold), output level (Out) and evaluation value (Evaluation).

First, the image density value (In) of a pixel of interest is added to a diffused error value (dIn) from the distribution of multi-value error of the surrounding pixels to obtain a corrected density value (In+dIn). Then, a comparator compares the corrected density value (In+dIn) that was found with a threshold value (threshold), and outputs an output level (Out) that is set according to the threshold value that corresponds to the corrected density value.

In the table in FIG. 5B that illustrates the relationship of the threshold value, the output level and the evaluation value of this embodiment, when the corrected density value (In+dIn) is 32 or less, Level 0 is outputted as the output level (Out). When the corrected density value is greater than 32 and less than 96, Level 1 is outputted as the output level (Out). When the corrected density value is greater than 96 and less than 160, Level 2 is outputted as the output level (Out). When the corrected density value is greater than 160 and less than 224, Level 3 is outputted as the output level (Out). When the corrected density value is greater than 224 and less than 255, Level 4 is outputted as the output level (Out).

Next, the multi-value error (Error=In +dIn−Evaluation) is calculated by subtracting the evaluated value (Evaluation) from the corrected density value (In+dIn).

Here, the relationship between the output level (Out) and the evaluation value (Evaluation) is derived from the table in FIG. 5B that illustrates the relationship between the threshold value, output level and evaluation value of this embodiment. When the output level (Out) is Level 0, 0 is outputted as the evaluation value (Evaluation). When the output level (Out) is Level 1, 64 is outputted as the evaluation value (Evaluation). When the output level (Out) is Level 2, 128 is outputted as the evaluation value (Evaluation). When the output level (Out) is Level 3, 192 is outputted as the evaluation value (Evaluation). When the output level (Out) is Level 4, 255 is outputted as the evaluation value (Evaluation).

Then, the error value that was diffused at the position of the pixel of interest is fetched from the error buffer, normalized by the total sum of weighting factors, and taken to be the diffused error (dIn) of the next pixel. In other words, in order to diffuse the calculated multi-value error into the pixels surrounding the pixel of interest, a weighting operation is performed and added to the error buffer. In this embodiment, error is diffused to the pixels to the right, directly below, to the lower right and to lower left. The weighting of each of the pixels is 4/8, 2/8, 1/8 and 1/8, respectively. In this embodiment, the multi-value error is diffused to the pixels described above using the weighting factors above; however, the present invention is not limited to this. For example, error can be diffused to the two adjacent pixels to the right of the pixel of interest, or to the two pixels below the pixel of interest, and the weighting can become lighter going away from and heavier going toward the pixel of interest.

The process above is repeatedly executed for all of the pixels.

With the processing above, the 8-bit, 256-gradation image data is quantized to the five gradation levels that can be printed by the printing apparatus 1.

Referring again to FIG. 3, in step S14, the printing dot arrangement inside the printing pixels is set from the image data that was quantized to a lower gradation in printing pixel units (step S15). Setting the arrangement of printing dots is performed by using a data printing position setting unit 35.

Figure 6A:
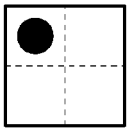
FIG. 6A to FIG. 6I are schematic diagrams illustrating the dot positions inside a pixel of a first embodiment.
Figure 6B:
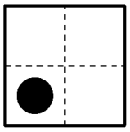
Figure 6C:
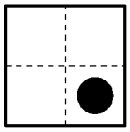
Figure 6D:
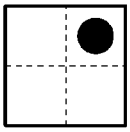
Figure 6E:
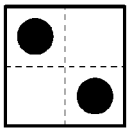
Figure 6F:
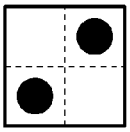
Figure 6G:
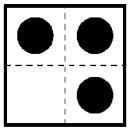
Figure 6H:
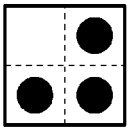
Figure 6I:
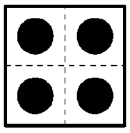

FIG. 6A to FIG. 6I are schematic diagrams illustrating the dot positions in a pixel according to the level for which the dot printing positions of this embodiment have been set. The printing pixels are 600 dpi, and express image data, which has been quantized to one of the five values 0 to 4, using a dot pattern having a printing dot resolution of 1200 dpi. For example, when the quantization result is level 1, one dot is printed inside the 600 dpi printing pixel, and that dot printing position repeats that four patterns of the upper left (FIG. 6A), lower left (FIG. 6B), lower right (FIG. 6C) and upper right (FIG. 6D).

After the dot printing positions are set, a used-nozzle array setting unit 36 distributes dot data to each nozzle array (step S16).

Next, the ink data density correction process (step S13), which is characteristic of the present invention, will be explained. The density correction process comprises an average integrated concentration value estimation process that estimates the change in ink density surrounding the nozzle, and a correction process that corrects the density based on the estimated integrated concentration value.

First, the processing method for estimating the change in ink density will be explained in detail. In this embodiment, in order to acquire information related to the extent of concentration in the nozzle, an integrated ink concentration value (hereafter, also referred to as the integrated value) and an average integrated ink concentration value (hereafter, also referred to as the average integrated value) are used as variables that express the degree of ink concentration. The integrated value is a parameter that is calculated based on the ink ejection history for each nozzle, and expresses the degree of ink concentration for each nozzle. In this embodiment, the form for printing one pixel using a plurality of nozzles is explained, and, the average integrated ink concentration value of a plurality of nozzles used in printing the target pixel is calculated and taken to be the average integrated ink concentration value. The average integrated value is used as a variable for estimating the change in density in this embodiment.

Figure 7:
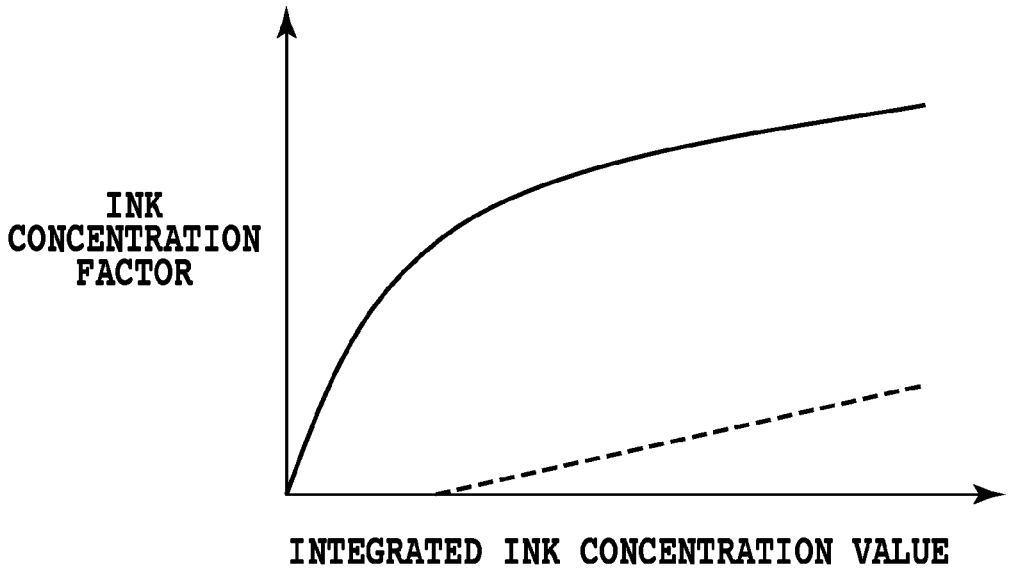
FIG. 7 is a graph illustrating the relationship between the integrated ink concentration value and the ink concentration factor.

FIG. 7 is a graph illustrating the relationship between the integrated ink concentration value and the ink concentration factor of this embodiment. The vertical axis indicates the integrated ink concentration value, and the horizontal axis indicates the ink concentration factor. These values have a relationship in which the ink concentration factor becomes higher the greater the integrated value is.

Here, the ink concentration factor is the ratio of the optical density (OD) of the ink dots that are printed with ink that is concentrated with respect to the optical density (OD) of ink dots that are printed with ink that is not concentrated. In other words, when the ink is not concentrated, the ink concentration factor is 1.

In FIG. 7, the solid line indicates the ink concentration factor of the first dot with respect to the integrated ink concentration value. It can be seen that the ink concentration factor becomes higher the greater the integrated value is. On the other hand, the dashed line indicates the ink concentration factor of the second dot when dots are printed in succession under the same conditions as the solid line. As in the case of the first dot, the ink concentration factor becomes higher the greater the integrated ink concentration value is; however, the slope of the curve is sufficiently small when compared with the case of the first dot. Therefore, no matter what the integrated ink concentration value is, the ink concentration factor is greatly reduced by the first ejection. However, as can be seen from FIG. 7, the ink concentration is not completely eliminated even after 1 dot is formed, and the ink concentration factor does not completely return to the original value (=1) by printing only 1 dot.

Figure 8A:
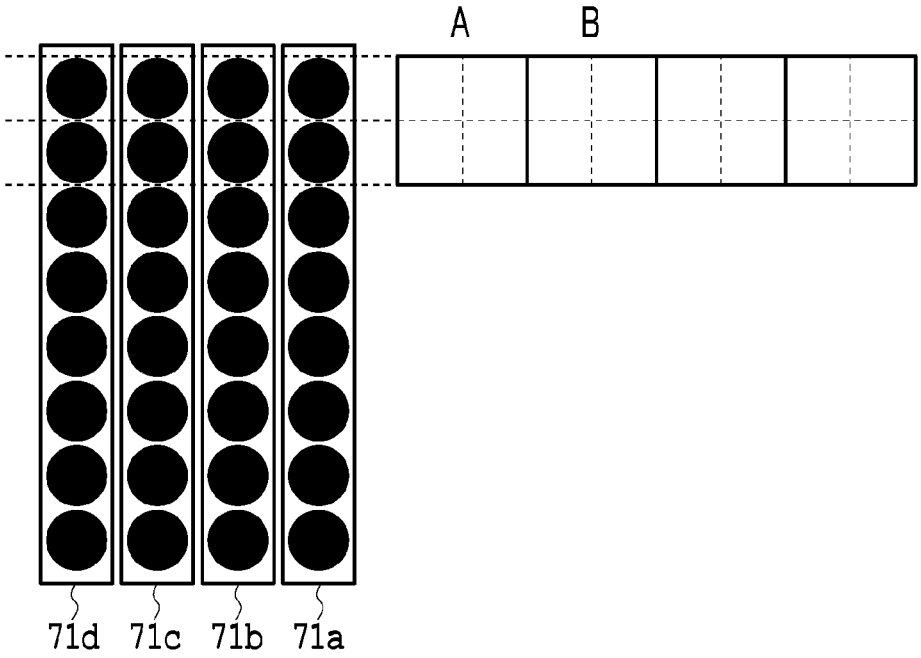
FIG. 8A and FIG. 8B are drawings for explaining the average integrated value that is used when estimating the change in density.
Figure 8B:
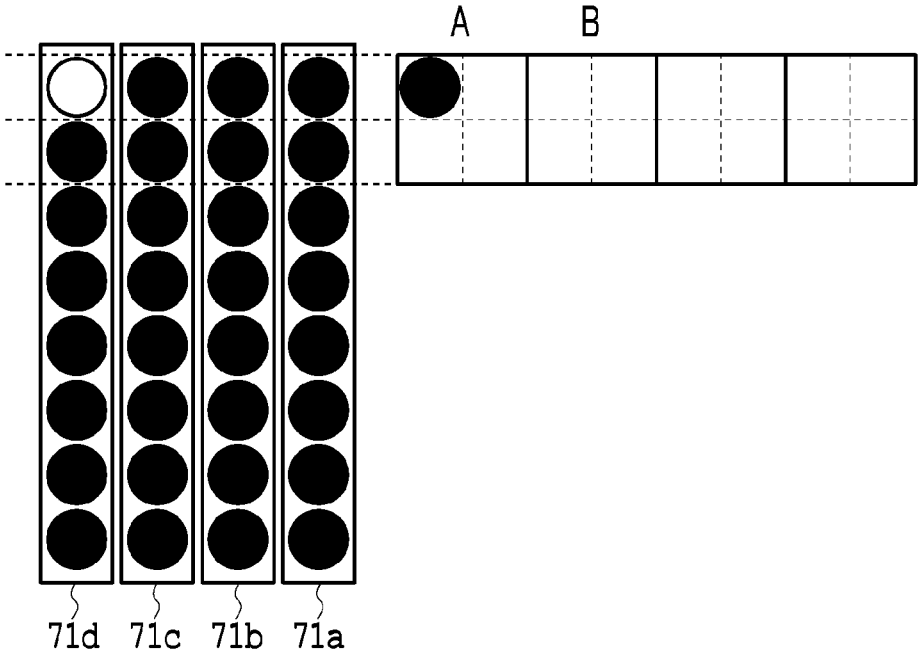

FIG. 8A and FIG. 8B are diagrams for explaining the average integrated value that is used in this embodiment when estimating the change in density. As illustrated in FIGS. 8A and 8B, in this embodiment, with a unit of 1 pixel being 600 dpi, in order to print a 1-raster image, two nozzles in each of the four nozzle arrays (71*a*, 71*b*, 71*c* and 71*d*), for a total of eight nozzles are used. The concentration characteristics of each nozzle is as illustrated in the graph of FIG. 7.

In this embodiment, the change in ink density is estimated and corrected based on ink data. The ink data is multi-value data before ejection data is generated that corresponds to the individual nozzles, so that it is not possible to identify which nozzles of which nozzle array form the dots of each pixel. On the other hand, it is possible to know from the ink data the number of dots that are ejected, and as a result it is possible to estimate the density using the average value of the integrated values of the plurality of nozzles used for printing (average integrated value). In other words, the average integrated value is acquired based on the total amount of change in the integrated values that are found from the ink data for the plurality of nozzles used in printing a unit area, and the ink concentration state for the unit area is estimated. At this time, it is presumed that each nozzle can be used at an equal probability in dot formation. In this embodiment, as illustrated on the right side in the figure, four 600 dpi pixels are taken to be a unit area, and the eight nozzles that are used in printing this area is explained.

FIG. 8A illustrates that all eight nozzles have the same state of concentration (nozzles indicated by black dots). For example, assuming that the integrated value of each nozzle in FIG. 8A is 1200, the average integrated value for pixel A is calculated as 1200×8/8=1200. FIG. 8B illustrates the state in which one dot is formed in one pixel by one of the nozzles from the state in FIG. 8A. The one nozzle that formed the dot is then in a state in which the concentration is eliminated to a certain extent because the concentrated ink was ejected (nozzle indicated by a white dot). From the dashed line in FIG. 7, the integrated value in this state is taken to be 200 for example. As a result, the average integrated value immediately after dot formation is performed is calculated as 1200×7/8+200×1/8=1075.

Figures 9A, 9B, 9C:
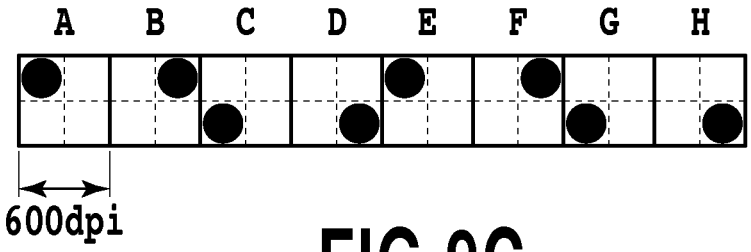
FIG. 9A to FIG. 9C are tables for setting the amount of change of the integrated concentration value of a first embodiment.

FIG. 9A to FIG. 9C are diagrams for explaining how the concentration state of ink is changed by printing of image data. The change amount table illustrated in FIG. 9A illustrates the ink data of a target pixel to be printed, and the amount that the average integrated value changes due to printing the target pixel from the average integrated value that indicates the concentration state during printing of a plurality of nozzles used in printing the target pixel. When ink is not ejected on the target pixel, the time that the ink is not ejected until the next pixel is taken into consideration, and a specified amount is added to the integrated ink concentration value. On the other hand, when ink is ejected, the integrated ink concentration value is subtracted. As a result, it is possible to acquire information about the integrated value of the next target pixel. In this embodiment, when ink is not ejected to the target pixel, +10 is added. Therefore, when the gradation value indicated by the ink data is 0, +10 is set as the value of the average integrated value regardless of the average integrated value.

Here, using FIG. 9*b* and FIG. 9C, the method for generating the change amount table in FIG. 9A will be explained. An image is prepared in which the values of the ink data are the same for each pixel (FIG. 9B). Here, the case in which the gradation value of the ink data of pixel is 64 is explained. Quantization is performed for the ink data having a gradation value of 64, and the dot arrangement is set (FIG. 9C). In FIG. 9C, the state where only one raster of FIG. 9B is taken is expressed, and the positions of the pixels are expressed as A to H. The amount of change of the average integrated value is calculated by assuming that the nozzles of each nozzle array are equally used in dot formation. The nozzles of each nozzle array being equally used in dot formation means that after the 8 nozzles are each used one time, they are used in order the second time. For example, it is expressed that in one 600 dpi pixel, the nozzles that form dots in the upper half are even nozzles, and the nozzles that form dots in the lower half are odd nozzles. For the pixels A to H in FIG. 9C, the even nozzles of nozzle array 71*a*, the even nozzles of nozzle array 71*b*, the odd nozzles of nozzle array 71*c*, the odd nozzles of nozzle array 71*d*, the even nozzles of nozzle array 71*c*, the even nozzles of nozzle array 71*d*, the odd nozzles of nozzle array 71*a*, and the odd nozzles of nozzle array 71*b* are used in order to form dots. For subsequent pixels, the order of using nozzles above is repeated. With this kind of nozzle usage, the average integrated value is calculated before the dot formation of each pixel.

In order to calculate the average integrated value, it is necessary to find the integrated value of each nozzle. The integrated value is calculated by adding an integrated value of +10 for the amount of time waited each time advancing one pixel, and referencing the integrated value of the remaining concentrated after dot formation from the dashed line in FIG. 7.

In pixel A in FIG. 9C, the integrated value for each nozzle is taken to be 1200. The average integrated value when printing pixel A is 1200. After one dot has been formed in pixel A, the integrated value of the even nozzles of the nozzle array 71*a* becomes 200. Next, the average integrated value when printing pixel B is calculated. An integrated value of +10 is added to all of the nozzles when moving from pixel A to pixel B. Therefore the integrated value for one nozzle is 210, and the integrated value of the remaining seven nozzles is 1210, so the average integrated value when printing pixel B is 1085.

By repeating the calculation above for each pixel, the average integrated value for each pixel is calculated. By taking the difference between the calculated average integrated value and that of the adjacent pixels for each pixel, it is possible to set the amount of change in the ink concentration due to printing each pixel. In pixel A in FIG. 9C, the average integrated value is 1200, and the value of the ink data is 64, so that the amount of change in the average integrated value due to printing this pixel becomes 1085−1200=−115. In other words, the amount of change is a negative value, so the ink concentration due to printing this pixel has decreased. As described above, when the ink data is 0, or in other words, when ink is not ejected for this pixel, the amount of change becomes a positive value.

As described above, it is possible to estimate the amount of change in the ink density of the nozzle due to printing this pixel from the ink data for each pixel and from the average integrated value when printing each pixel.

Next, the method of the correction process for correcting the density based on the estimation of the density change of the ink will be explained in detail.

Figures 10A, 10B:
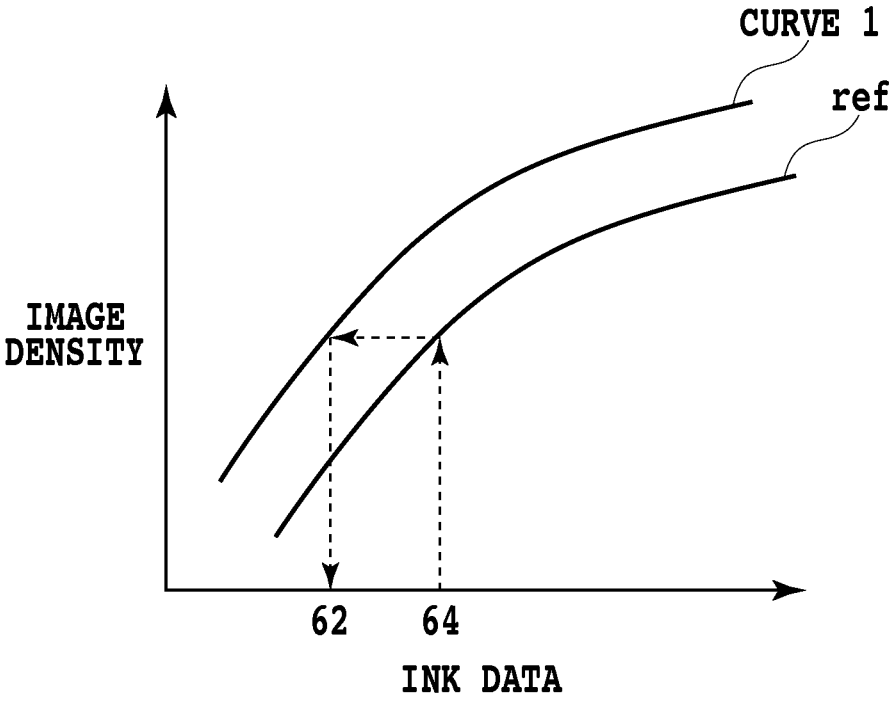
FIG. 10A and FIG. 10B are drawings of the correction process for correcting the ink density of a first embodiment.

FIG. 10A and FIG. 10B are diagrams for explaining the correction process for correcting the ink data values. FIG. 10A illustrates part of a correction table that is used for correction. FIG. 10B is a graph used for generating the correction table.

In the correction table in FIG. 10A, the ink data for the target pixel that is the object of processing and the correction value for correcting the ink data of that pixel are set. A correction value is provided for each value that the ink data indicates, and in this embodiment, is set for each value 0 to 255. Furthermore, the density becomes higher the higher the ink concentration factor is, so as the average integrated value becomes greater, the correction value is set such that the absolute value of the correction value becomes greater. In this embodiment, when the ink concentration factor is high, the correction value becomes a negative value. Moreover, the correction value is set to five levels using threshold values for four average integrated values. The levels of the correction amounts of the present invention are not limited to five, and it is possible to change the level based on various factors such as the type of ink, quality of the image, and the like. For example, when the value of the ink data is 64, 1100 is set as the threshold value for the first average integrated value. When the average integrated value is 0 or greater and less than 1100, a correction value of 0 (no correction) is applied. When the average integrated value is equal to or greater than the second threshold value of 1100 and less than 1200, the correction amount −1 of the second stage of the integrated value table is applied. After that, when the average integrated value is equal to or greater than the third threshold value of 1200 and less than 1300, the correction amount −2 is applied, and when the average integrated value is equal to or greater than the fourth threshold value of 1300 and less than 1400, the correction amount −3 is applied. When the average integrated value is 1400 or greater, the correction amount −4 is applied.

Next, the method of setting the parameters of the correction table will be explained. When generating the correction table, an image having uniform density for each ink data is used, and quantization is performed for that image having uniform density to generate dot arrangement data. Then, based on the dot arrangement data, density correction is performed using the integrated concentration values, and threshold values and correction amounts are set.

An image having uniform density of ink data 64 will be explained as an example. Density correction of ink data that is performed using the integrated concentration value is performed according to feedback control, and corrects the ink data of the target pixel before the dot arrangement is set according to the integrated value of the target pixel to be corrected that was calculated by setting the dot arrangement. By setting the dot arrangement as illustrated in FIG. 9C, the nozzles to be used for dot formation of each pixel are set. As a result, it is possible to calculate an integrated concentration value for each pixel, which indicates the degree of concentration of the nozzle when printing the pixel.

Here, the one row of pixels in the printing area in the direction of the nozzle is called one column. In this embodiment, a method of calculating the average of integrated values for one column of a uniform solid image, and then performing the same correction for the entire one column is used as the density correction of the ink data. After correction has been performed for the ink data of the target column to be corrected, the dots of the corrected target column are in a thinned state, so the integrated values of part of the dots that are formed in the column after the target column are changed from that before correction. Therefore, in order to calculate the integrated values correctly, it is necessary to perform quantization again after the values indicated by the ink data of the corrected target column have been corrected, and to calculate and correct the integrated values of the next column for which correction has been performed. In this way, the entire image is corrected by repeating quantization and correction one column at a time.

FIG. 10B is a graph for generating a correction table, and the amount of correction from correcting the ink data is calculated from the relationship between the image concentration and the ink data. Each curve represents the density of the printed image with respect to the ink data when an image having uniform ink data, or in other words, when an image having uniform density is printed using nozzles having the same integrated concentration values. The ref curve represents the relationship between the inputted ink data and the density of an image that was printed using nozzles having an integrated value of 0 (state of no concentration). On the other hand, curve 1 represents the relationship between the inputted ink data and the density of an image that was printed using nozzles having an integrated value of 1200.

When the value of the inputted ink data is 64, in order for the image printed by nozzles having the ink concentration of curve 1 to obtain the same density as an image printed with nozzles in a state of no ink concentration, it is necessary to make the value of the ink data 62 as indicated by the arrow in the figure. Therefore, the correction amount of the integrated value 1200 is set to 62−64=−2. In this kind of method, this kind of curve is created for various integrated values, and by comparing the curves with the ref curve, it is possible to set the amount of correction for each ink data in order to obtain the same image density as the nozzles in a state of no ink concentration. In this way, correction amounts that correspond to an infinite number of integrated concentration values can be set; however, in this embodiment, areas of integrated values having the same correction amount are found such that there are five levels of correction, and a correction table is generated by setting threshold values and using the integrated values.

The threshold values and correction amounts in the correction table of the correction processing method that uses the average integrated concentration values are set as described below from the correction results of an image having uniform density of each of the ink data that used the integrated values. The correction method that uses integrated values repeatedly sets the dot arrangement, calculates the integrated values, and performs correction one column at a time. When calculating the integrated concentration values, the average integrated concentration value is calculated at the same time. The correction amount for the average integrated value is set by correlating the average integrated value that was calculated for each column with the correction amount that was corrected by the column. The threshold values and correction amounts of the correction table of the correction processing method that used the average integrated value are set by performing the same kind of correction with each ink data. By creating a correction table for the correction processing method that uses the average integrated value in this way, it is possible to perform correction with the same degree of accuracy as when performing correction by finding integrated values from the dot arrangement data.

Figure 11:
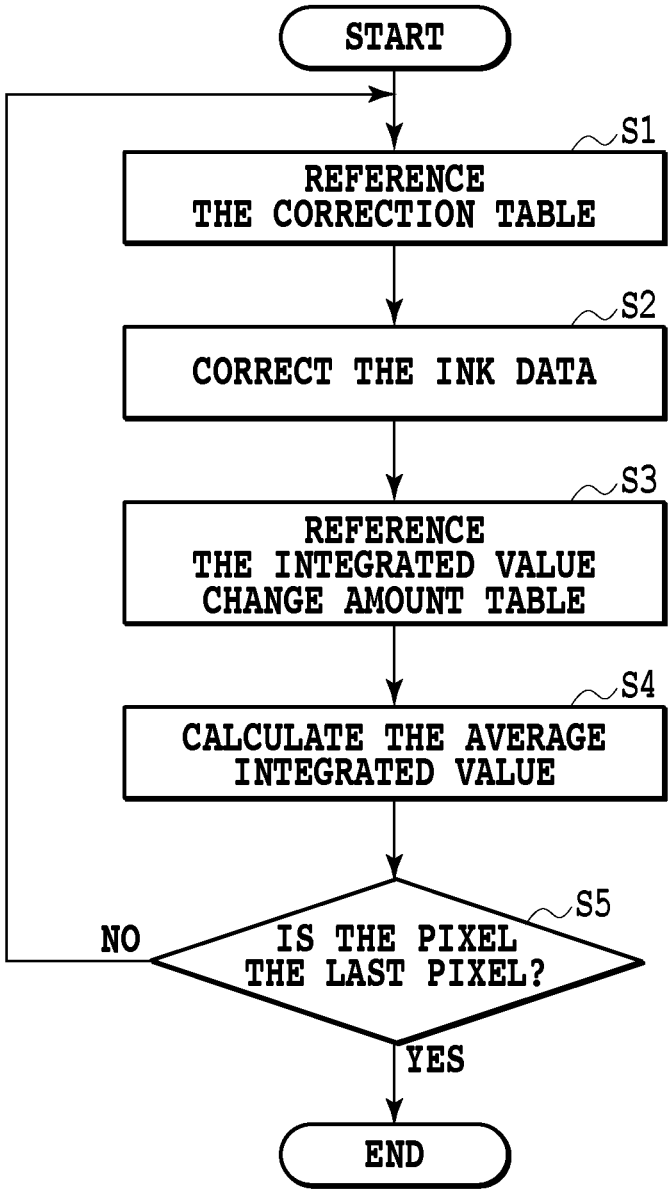
FIG. 11 is a flowchart that illustrates the correction process of a first embodiment.
Figure 12:
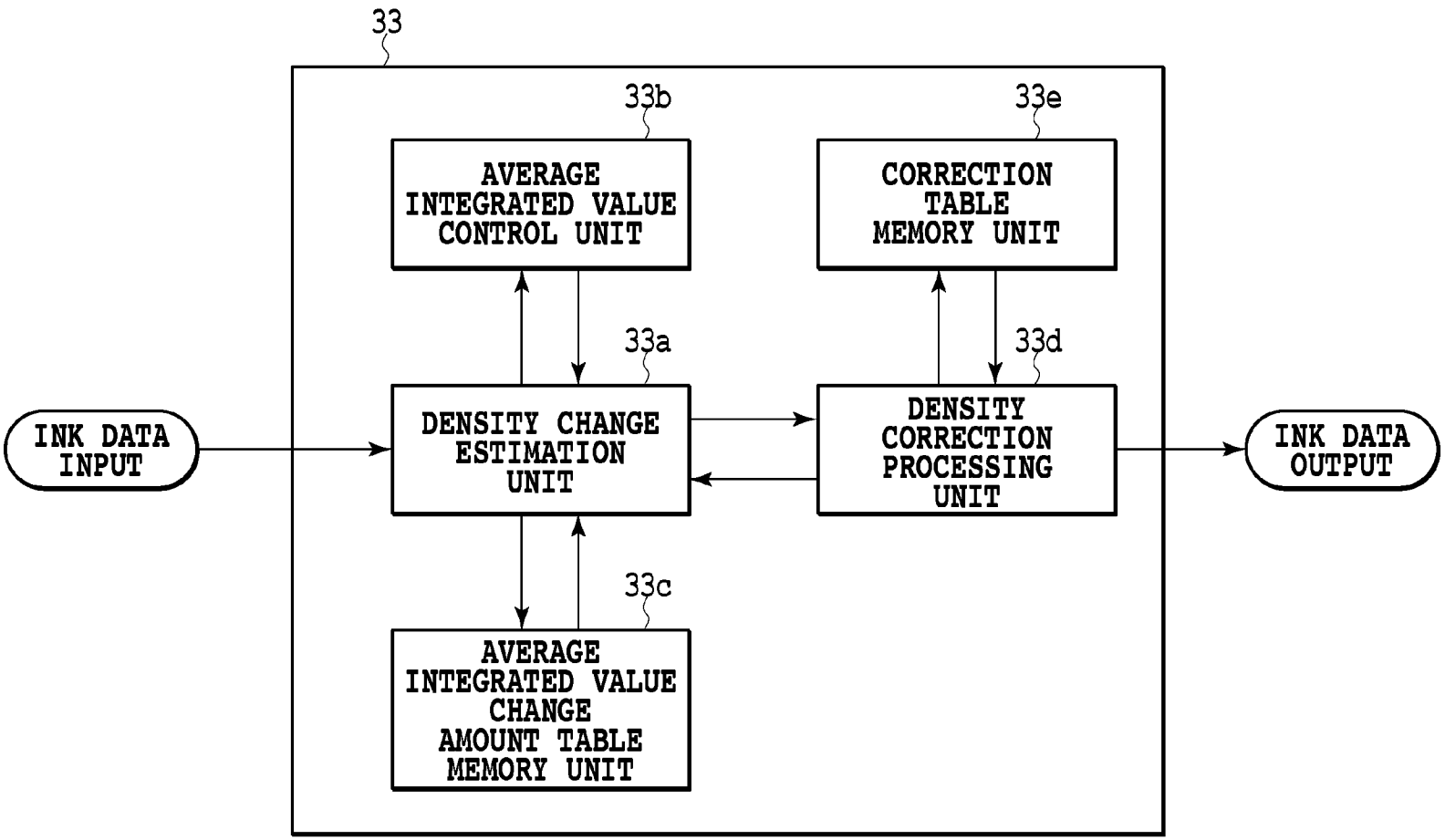
FIG. 12 is a block diagram for explaining the concept of the correction process of a first embodiment.

FIG. 11 is a flowchart illustrating the correction process of this embodiment. FIG. 12 is a block diagram for explaining the correction process of this embodiment.

In this embodiment, an example of correcting an image having uniform density with an ink data value of 66 in a concentration state where the average integrated value is 1200 will be explained.

In step S1, a density correction processing unit 33*d* uses ink data (66) for the target pixel and the average integrated value (1200) that is stored in an average integrated value control unit 33*b* to acquire a corresponding correction amount (−2) from that correction table that is stored by a correction data memory unit 33*e* (refer to FIG. 10A). This average integrated value is a value that reflects the degree of concentration of the nozzles that changes due to the printing of the pixel that is printed one before the target pixel by a plurality of nozzles that are used for printing the target pixel. Next, in step S2, the acquired correction value is added to the ink data. In this embodiment, the ink data after correction becomes 66−2=64. In step S3, a density change estimation unit 33*a* references the average integrated value change amount table that is stored by a integrated value change amount table memory unit 34*c* based on the ink data (64) after correction that was received from the density correction processing unit 33*d* and the average integrated value (1200), and acquires the amount of change (−115) (refer to FIG. 9A). In step S4, the acquired amount of change (−115) is added to the average integrated value (1200), the average integrated value (1085) that is used in the pixel that can eject by this plurality of nozzle (is adjacent to the target pixel is calculated and saved in the average integrated value control unit 33*b*. In step S5, it is determined whether or not the target pixel is the last pixel. When it is determined that the target pixel is not the last pixel, processing returns to step S1 and steps S1 to S4 are repeated. However, when it is determined that the target pixel is the last pixel, the correction process ends. The average integrated value stored in the average integrated value control unit 33*b* at the start of the correction process is set to 0.

In this embodiment, an example was given of estimating the change in density and performing correction of ink data for each one pixel in 600 dpi units, however, it is also possible to perform estimation of the change in density using a collection of a plurality of pixels.

As described above, the present invention comprises a change amount table that indicates from the ink data that is to be printed for a target pixel in a printing area and the average integrated value of that target pixel to what degree the state of ink concentration will be eliminated by printing the target pixel. From this change amount table it is possible to acquire from the ink data the average integrated value that indicates the state of concentration of each pixel, and to correct the ink data based on that average integrated value. In other words, even without generating ejection data about ink ejected from each individual nozzle, by acquiring the state of ink concentration of each pixel from multi-value ink data as the average value of a plurality of nozzles, it is possible to perform correction at high speed. Furthermore, the present invention comprises a correction table that indicates correction values for correcting ink data from the acquired average integrated value and the ink data value. This correction table was explained as having five correction values that correspond to average integrated values that have been divided into five ranges using four threshold values, however, it is possible to perform highly precise correction by performing more detailed correlation with the average integrated value by using a larger number of threshold values.

Moreover, in this embodiment, the resolution of the image data is 600 dpi and the printing resolution of the printing apparatus (nozzle resolution in this embodiment) is 1200, so a form of printing one raster having a 600 dpi resolution with eight nozzles is used. The present invention could also have a form wherein the resolution of the image data is the same as the printing apparatus. For example, when the resolution of both is 1200 dpi, printing one raster of image data is performed with four nozzles. In this case, the average integrated value of the target pixel can be found for four nozzles.

Embodiment 2

In the first embodiment, the average integrated concentration value for each pixel was found for each pixel using the table of ink data and average integrated concentration values illustrated in FIG. 9A; however, the present invention is not limited to that method.

Figure 13:
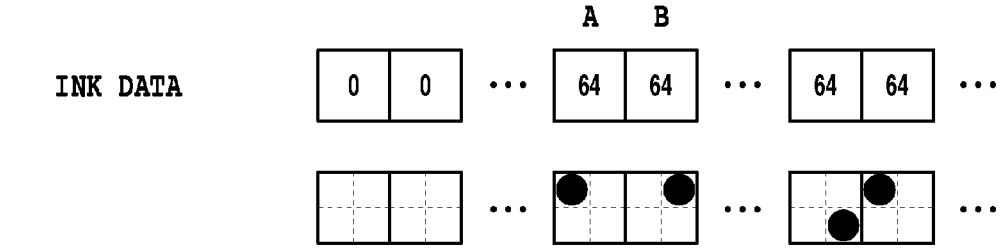
FIG. 13 is a drawing for explaining the method for calculating the average integrated concentration value of a second embodiment.
Figure 14:
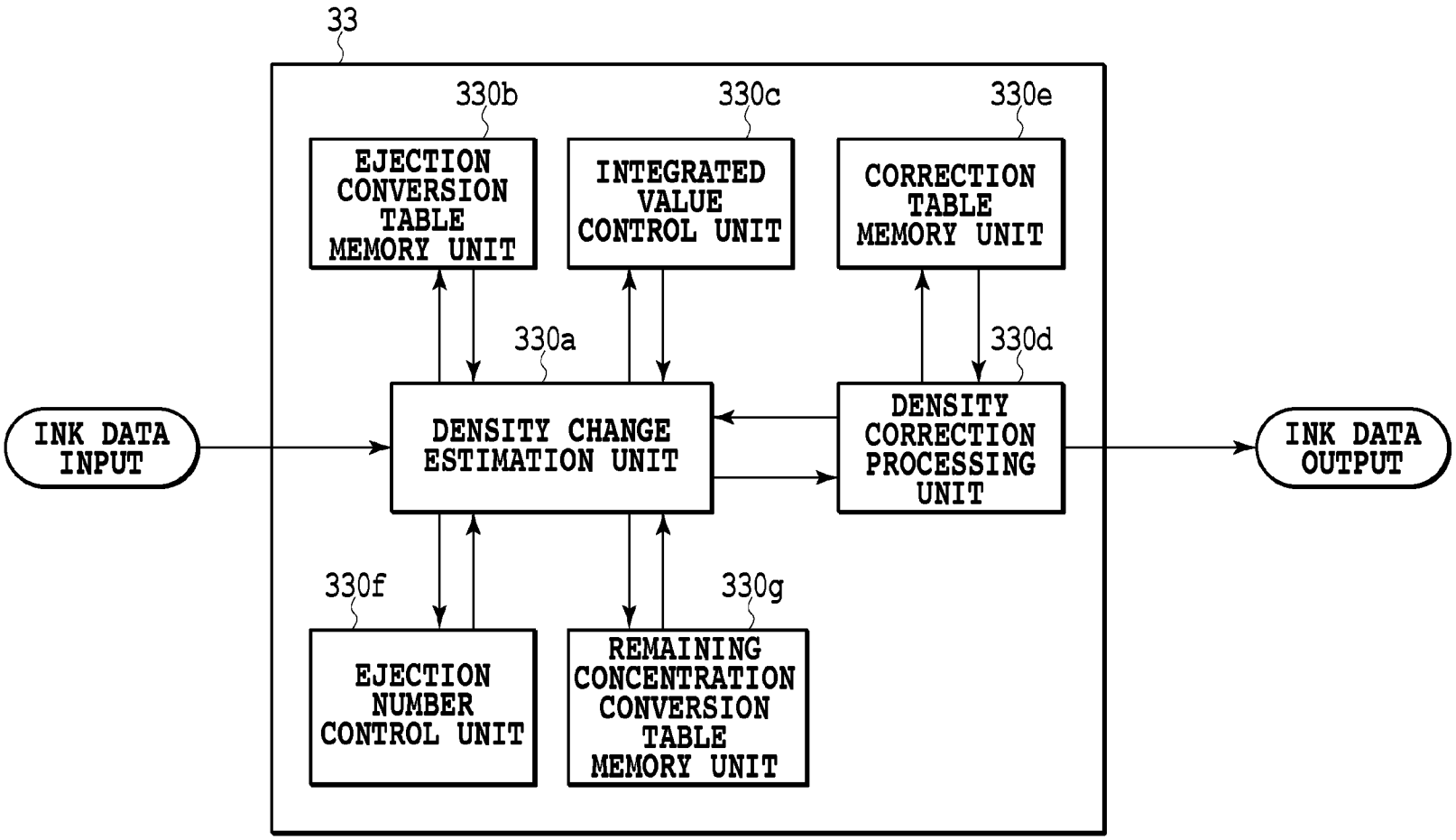
FIG. 14 is a block diagram illustrating the ink data correction process of a second embodiment.

FIG. 13 is a diagram for explaining a calculation method of this embodiment for calculating the average integrated concentration value for each pixel. FIG. 14 is a block diagram illustrating the correction process of ink data of this embodiment.

The image data of this embodiment is in units of 600 dpi per pixel, and a four nozzles array can be used for one raster having a resolution of 1200 dpi, so that eight nozzles are used for one pixel. The ink input value 64 is in a state where one dot is formed for each 600 dpi. An integrated value control unit 330*c* and ejection number control unit 330*f* store the memory area for managing the integrated concentration value of ink drops for each pixel, and the number of ink drops to be ejected in order for the ink to become normal, respectively.

In this embodiment, the area for integrated concentration value control and the area for ejection number control are divided into three groups for each pair. There is a first integrated concentration value control and first ejection number control, a second integrated concentration value control and second ejection number control, and a third integrated concentration value control and third ejection number control. In this embodiment, it is presumed that after three drops of ink are ejected, the concentrated ink is returned to the normal state. Therefore, three pairs of integrated concentration value control and ejection number control are prepared. The first integrated concentration value control and first ejection number control perform control of the ink drops that are ejected first from the plurality of nozzles, the second integrated concentration value control and second ejection number control perform control of the ink drops that are ejected second from the plurality of nozzles, and the third integrated concentration value control and third ejection number control perform control of the ink drops that are ejected third from the plurality of nozzles.

After correction has started, first, in the initial state, 8 is set for the first ejection number control, and 0 is set for the other ejection number control. The integrated value control is also set to 0.

The concentration change estimation unit 330*a* adds an integrated value of 10 to the integrated value control for which the ejection number control is not 0 each time the processing advances one pixel. In this embodiment, the integrated value is added only to the first integrated value control. For a pixel in which a dot is not formed, the integrated value is added, and processing advances to the next pixel. For a pixel in which a dot is formed, the average integrated value is calculated and correction is performed.

Calculation to find the average integrated value of a pixel of interest is as follows:

Average integrated concentration value=(First integrated value)×(First ejection number)/8+(Second integrated value)×(Second ejection number)+(Third integrated value)×(Third ejection number)/8

In this embodiment, in order to simplify the explanation of the average integrated value, correction of ink data for each pixel will not be performed.

When formation of one dot is performed at the position of pixel A, one ejection is subtracted from the first ejection number control value to become 7, and one ejection is added to the second ejection number control value to become 1. This operation indicates that one nozzle from among eight nozzles is used for dot formation, and the concentration state becomes eliminated. The concentration change estimation unit 330*a* sets the integrated value that corresponds to the ink concentration after dot formation from the first integrated value for pixel A by referencing the conversion table of a remaining concentration conversion table memory unit 330*g*. The remaining concentration conversion table is a table that, based on the graph of the concentration characteristics in FIG. 7, correlates the integrated value with the integrated value that indicates the remaining concentration. In order to simplify the explanation, the integrated value that corresponds to the remaining ink concentrated and that is to be added to the second integrated value control is presumed to be 200.

Next, the correction process advances to pixel B, and +10 is added to the first integrated value control for which the ejection number control is 0. Also, at pixel B, the formation of one dot is performed. When doing this, 1 is subtracted from the ejection number control value to become 6, and 1 is added to the second ejection number control value to become 2. Moreover, from the integrated control value at pixel A, +10 is added to the integrated control value 200 due to the formation of a dot at pixel B, so the second integrated control value becomes 205, which is the average of 200 and 210.

In other words, the second integrated value={(the second integrated value before dot formation)×(the second ejection number before dot formation)+(the integrated value of the new remaining concentration)×(number of dots formed)}/{(second ejection number before dot formation)+(number of dot formed)}.

The density change estimation unit 330*a* references the integrated value for the remaining concentration from the remaining concentration conversion table, performs the following operation for calculating the second integrated value, and sets the second integrated control to the calculated value.

The process above is repeated until the first ejection number becomes 0. After the first ejection number becomes 0, the process that was performed in the first integrated control and first ejection number control is then performed in the second integrated value control and second ejection number control, and the process that was performed in the second integrated value control and second ejection number control is performed in the third integrated value control and third ejection number control. When the second ejection number becomes 0, the process that was performed in the second integrated value control and second ejection number control is performed in the third integrated value control and third ejection number control, and the process that was performed in the third integrated value control and third ejection number control is performed in the first integrated value control and first ejection number control. In this way, three integrated value controls and ejection number controls are repeatedly used to perform processing for the entire image.

In this embodiment, a table (not illustrated in the figures) for converting the ink data to the number of dot formations (number of ink ejections) is prepared, and a (ejection conversion table memory unit 330*b*) references the number of dot formations from this table when calculating the average integrated value. The relationship between the ink data and number of dot formations is set by creating an image having uniform density for each ink data, and calculating the number of dots per pixel from the number of dot formations of that image.

Figure 15:
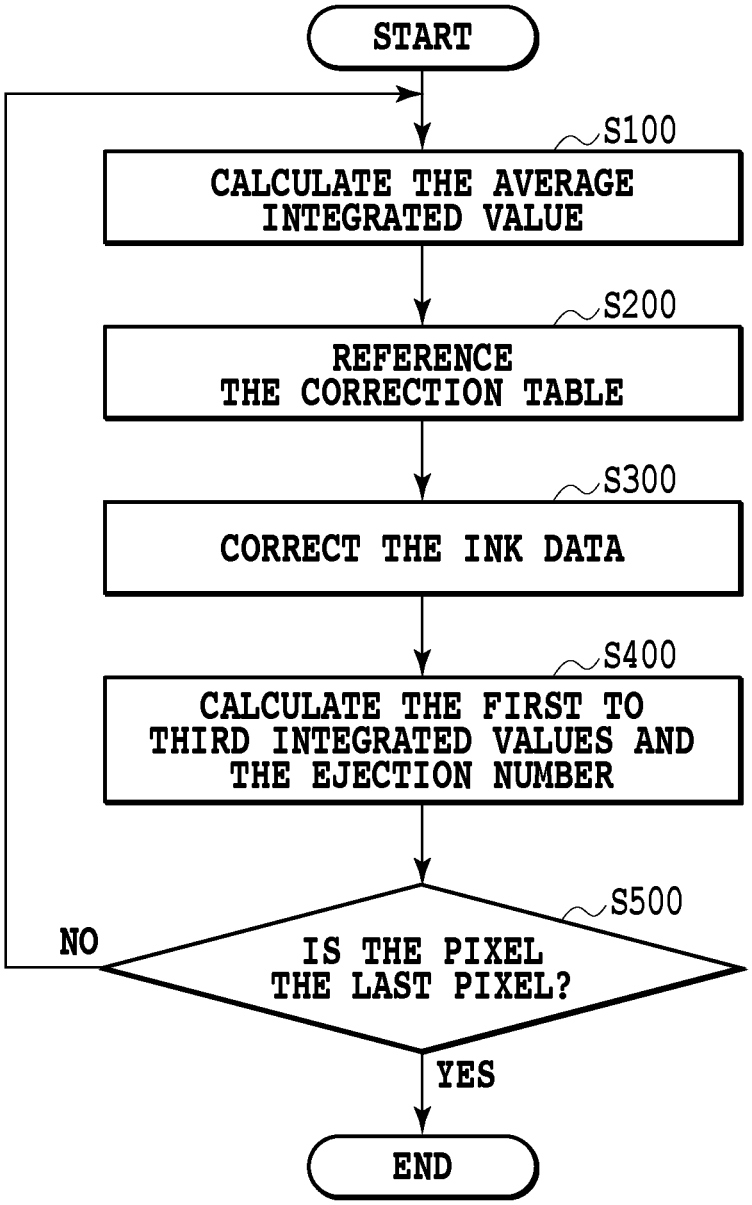
FIG. 15 is a flowchart illustrating the correction process of the second embodiment.

FIG. 15 is a flowchart illustrating the correction process of the second embodiment. An example is given of correcting an image having uniform density for ink data 66 in the state where the first integrated value is 1200, the first ejection number is 8 and the other integrated values and ejection numbers are 0. In step S100 in FIG. 15, the density change estimation unit 330*a* calculates the average integrated value of the corrected target pixel from each integrated value stored in the integrated value control unit 330*b* and the ejection numbers stored in the ejection number control unit 330*f*. The first integrated value is 1200, the first ejection number is 8 and the other integrated values and ejection numbers are 0, so the average integrated value becomes 1200. In step S200, the density correction processing unit 330*d* uses the ink data 66 for the target pixel average integrated value 1200 that was calculated by the density change estimation unit 330*a*, and references the corresponding amount of correction −2 from the correction table that is stored by the correction table memory unit 330*e* (refer to FIG. 10A). Next, in step S300, correction is performed so that the referenced correction amount is added to the ink data to become 66−2=64. In step S400, first, the density change estimation unit 330*a* uses the ejection conversion table stored in the ejection conversion table memory unit 330*b* can convert the correction ink data 64 that was received from the density correction unit 330*d* to the number of dots formed. For ink data 64, one dot is formed, so 1 dot formation is referenced. Next, the density change estimation unit 330*a* performs the calculation method explained above using FIG. 13, and stores each integrated value and ejection number in the integrated value control unit 330*c* and ejection number control unit 330*f*. In step S500, when the target pixel is not the last pixel, processing returns to step S1, and processing of steps S100 to S400 is repeated. When the target pixel is determined to be the last pixel, the correction process ends.

With the construction described above, correction is performed for the multi-value image data before setting the dot arrangement using a correction amount based on the density of the image. As a result, the correction process for correcting uneven density that occurs due to the concentration of ink when ink is not ejected from a nozzle, can be performed adequately and in a short time based on the degree of ink concentration.

Embodiment 3

In the first embodiment, the amount of change in the average integrated value was calculated by assuming that each of the nozzles of a nozzle array are used equally to form dots. However, in this embodiment, there are nozzles that are used two times before all of the nozzles have been used one time each.

Figure 16:
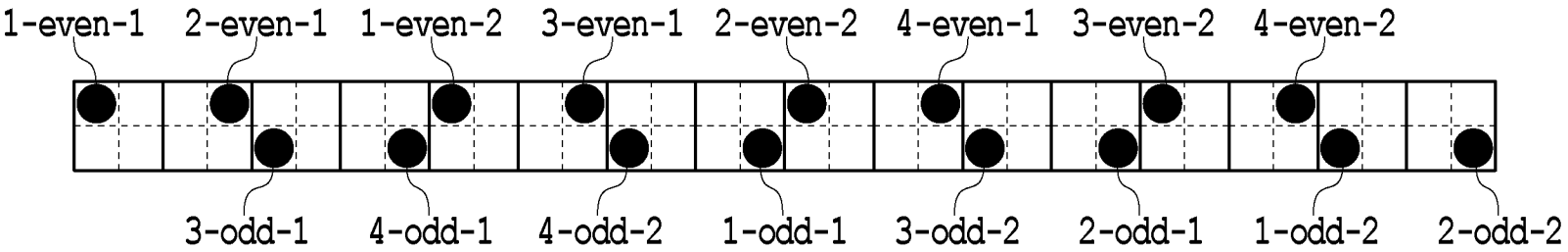
FIG. 16 is a diagram illustrating an index pattern of a third embodiment.

FIG. 16 is a diagram illustrating the index pattern for selecting the nozzles for forming dots in this embodiment. A method that uses four arrays of eight nozzles when forming one dot at a time for a pixel that is 600 dpi is illustrated. In the FIG. 16, 1-odd-1 indicates the first time that the odd nozzles of the first nozzle array are used. The nozzles are not used in order, and before all of the nozzles have been used one time each, there are nozzles that are used the second time. In this way, in the present invention, it is not necessary that nozzles in each nozzle array be used equally in dot formation as in the first embodiment.

Moreover, in the first embodiment an integrated value change amount table was created in the unit of 600 dpi per pixel. However, the table is not limited to the unit of 600 dpi per pixel, and it is possible, for example, to create the integrated change amount table by finding the integrated concentration values and average integrated concentration values in the unit of 300 dpi per pixel. The correction table is created according to the input resolution of the image (in the present invention, this is 600 dpi). The process for estimating the changing in ink density and the process of correcting the density based on estimation of this third embodiment is the same as in the first embodiment.

With the construction described above, multi-value image data is corrected using a correction amount based on the density of the image before the dot arrangement is set. As a result, the correction process for correcting uneven density that occurs due to the concentration of ink when ink is not ejected from a nozzle, can be performed adequately and in a short time based on the degree of ink concentration.

Embodiment 4

In the first embodiment the same correction process was performed for all areas of the image. However, in this embodiment, when printing using ejection substrates that are arranged in a zigzag manner, different change amount tables and correction tables are used for connecting sections and non-connecting sections when performing the density correction process.

Figure 17:
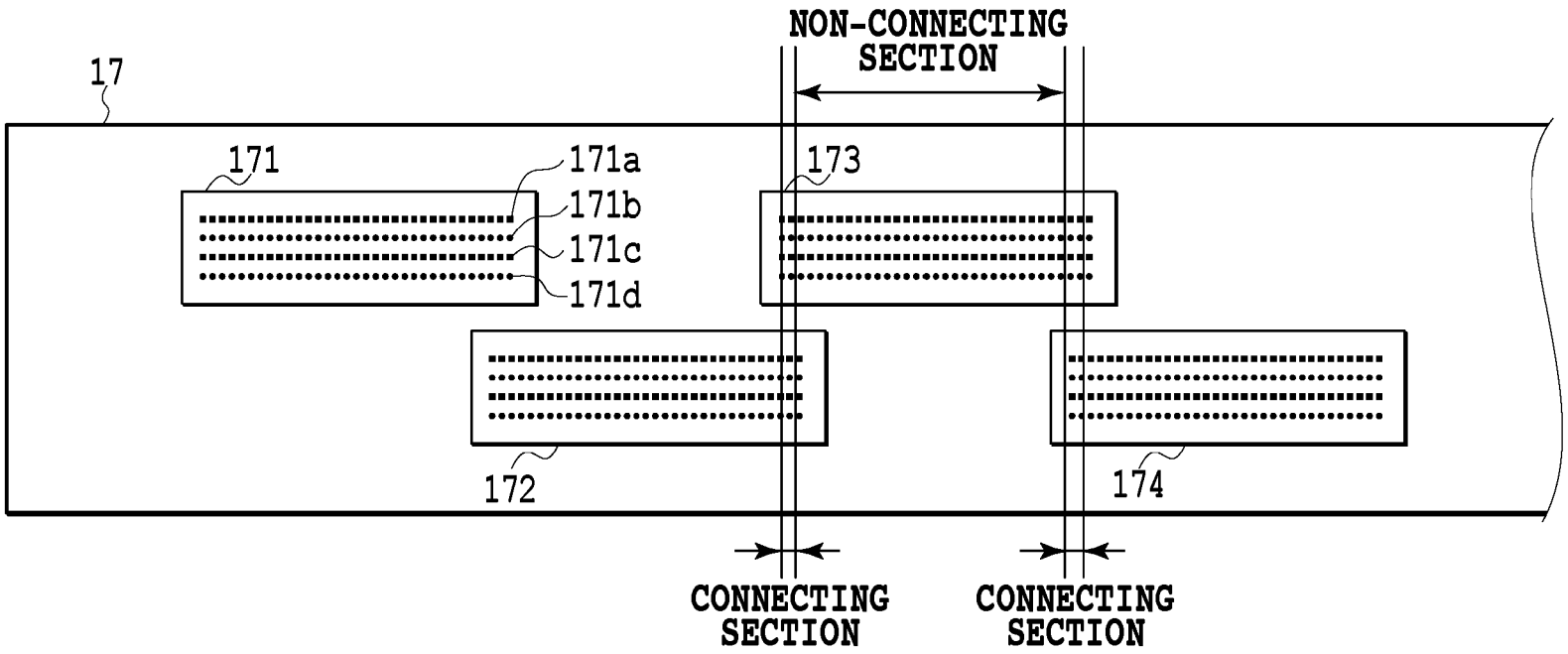
FIG. 17 is a schematic diagram illustrating the ejection substrate of a fourth embodiment.

FIG. 17 is a schematic diagram illustrating the ejection substrates of this embodiment. Here, a connecting section is an area where printing is performed by nozzles of two different ejection substrates as illustrated in FIG. 17, and a non-connecting section is an area where printing is performed only by nozzles arranged in one ejection substrate. The arrangement of the ejection substrates of a head in this embodiment is staggered, and there are areas where nozzle arrays of adjacent ejection substrates overlap in the conveying direction of the printing medium.

Figure 18:
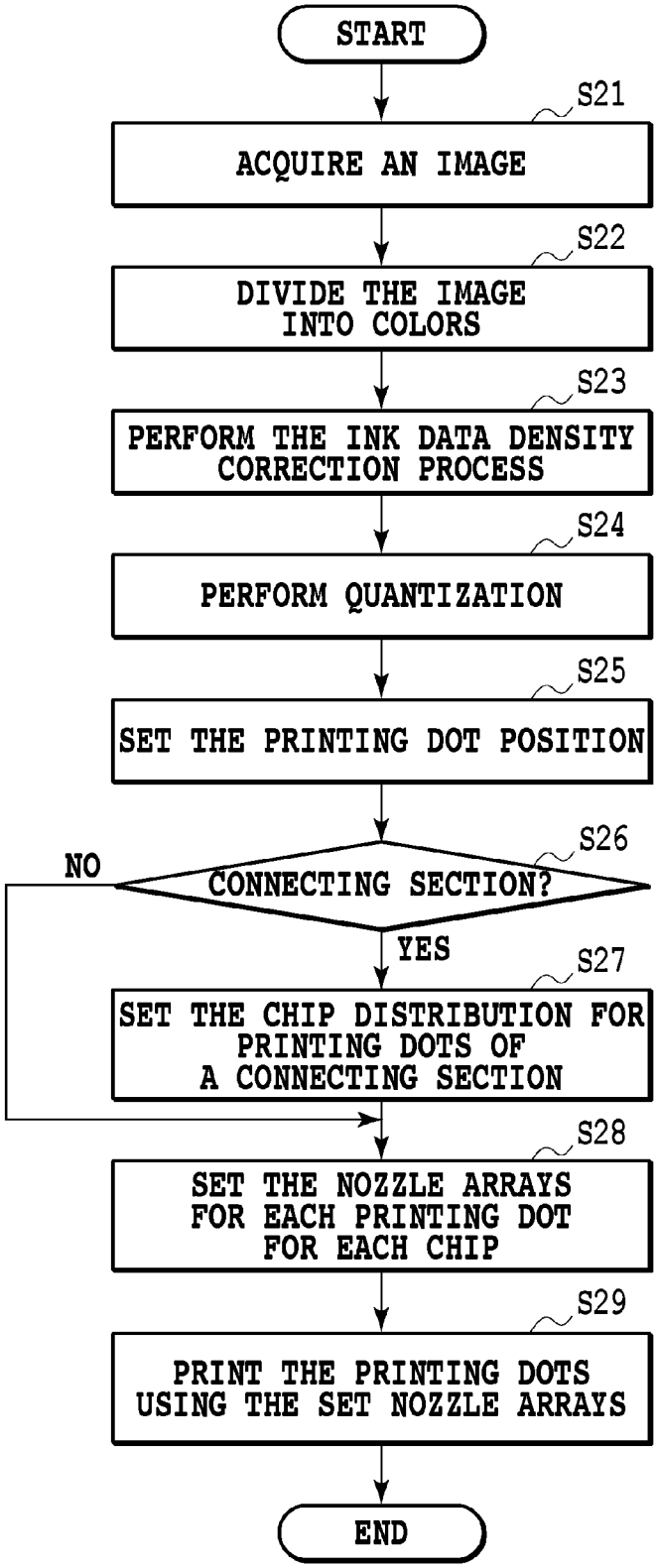
FIG. 18 is a flowchart illustrating image processing of a fourth embodiment.

FIG. 18 is a flowchart illustrating image processing of this embodiment. Of the image processing of this embodiment, from the acquiring of the image (step S21) to the setting of the printing dot arrangement (step S25), the same processing is performed as explained above with reference to steps S11 to S15 in FIG. 3 of the first embodiment. Then, it is determined whether or not there are connection sections (step S26), and when there are connecting sections, which ejection substrates will print the ink dots that are printed in the connecting sections is assigned randomly so that the distribution factor becomes uniform (step S26). The printing nozzle arrays are set for each printing dot (step S27), and the printing dots are printing by the set nozzle arrays (step S28).

In the non-connecting sections, this embodiment is the same as that explained using FIGS. 8A and 8B for the first embodiment, and in the dot formation of one raster a total of eight nozzles in four nozzle arrays are used. Moreover, in the connecting sections in this embodiment, a total of 16 nozzles in eight nozzle arrays are used in the dot formation of one raster. In other words, the number of nozzles that are used in the dot formation of one raster differs in the connecting sections and non-connecting sections. Therefore, in this embodiment, for each raster, correction is performed by checking whether the raster is a connecting section or a non-connecting section and then using the appropriate change amount table.

Figure 19:
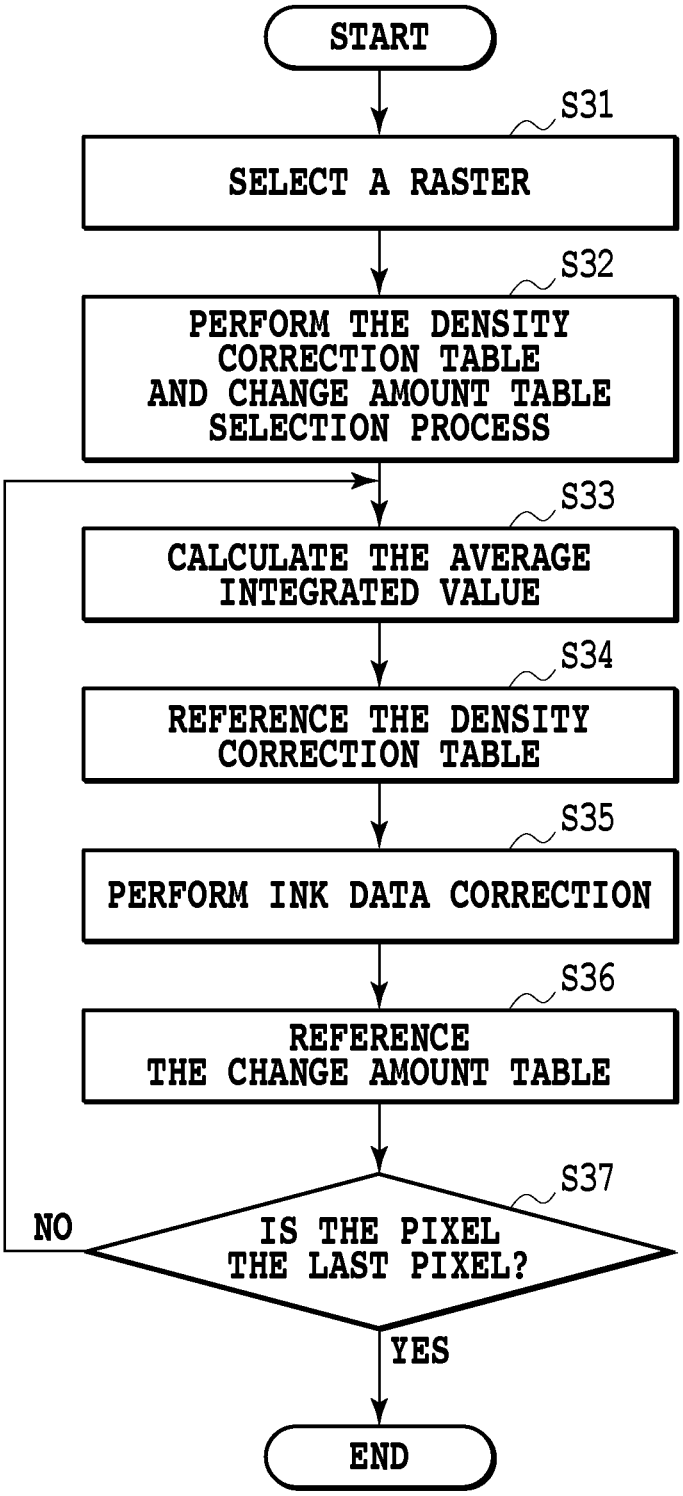
FIG. 19 is a flowchart illustrating the ink data density correction process of a fourth embodiment.

FIG. 19 is a flowchart of the ink data density correction process of this embodiment. In the ink data density correction process of this embodiment, after the raster to be processed has been selected (step S31), a table selection process is performed in order to select for each raster which change amount table and correction table to use (step S32).

Figure 20:
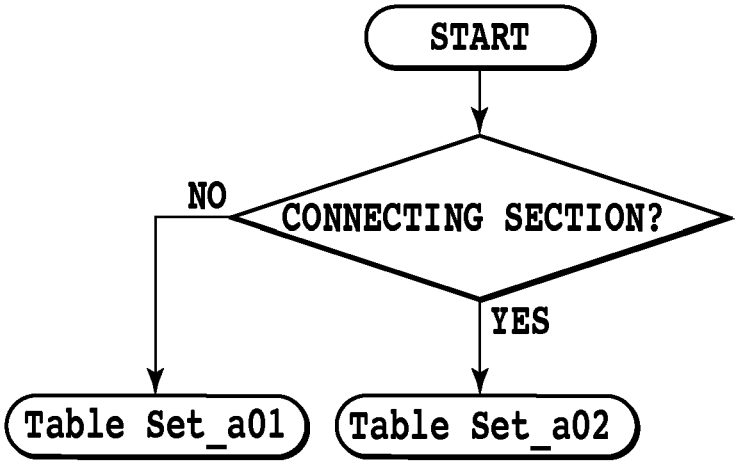
FIG. 20 is a flowchart illustrating a table selection process of a fourth embodiment.

FIG. 20 is a flowchart illustrating the table selection process of this embodiment. Whether or not the target raster belongs to a connecting section or a non-connecting section is determined, and the table set of a change amount table and correction table to be used is set.

FIG. 21A is a diagram illustrating a selection table of this embodiment. In this embodiment, the tables to be used are selected from the table illustrated in this figure based on the flowchart in FIG. 20.

Except for part of the calculation method of the tables used for the density change estimation process and density correction process between non-connecting sections and connecting sections, the density change estimation process and the density correction process are the same as in the first embodiment. Therefore, for this embodiment, only the calculation methods for each table will be explained below.

The point where the calculation method of the density change estimation table for connecting sections differs from that for non-connecting sections is the calculation method for calculating the average integrated value due to the difference in the number of nozzles used for dot formation of one raster.

A uniform solid image is prepared for each ink data. Next, the quantization used in this embodiment is performed in order set the dot arrangement. The amount of change in the average integrated value is calculated by presuming that all of the nozzles in each of the nozzle arrays (four arrays in two chips for a total of eight arrays) are used equally in dot formation. The integrated value is increased by adding an integrated value of +10 for the amount of time waited each time advancing one pixel, and the integrated value of the remaining concentration after dot formation is calculated by referencing the dashed line in FIG. 8A. After all of the integrated values have been calculated and the average value is found for each column, that average value is taken to be the average integrated value. By taking the difference between this average integrated value and that of the adjacent pixel for each pixel, the amount of change corresponding to the average integrated value and the ink data is found. This is found for each ink data and a change amount table is made.

The correction table for connecting sections is found in the same way as the density correction table in the first embodiment, so an explanation is omitted here.

As described above, by setting a correction table for each raster, it is possible to reduce a decrease in image quality due to unevenness more than when performing correction of the entire image using the same table.

Embodiment 5

In the first embodiment, the same correction process was performed for all areas of an image. In this embodiment, when there are nozzles that do not eject ink, the printing data that is to be printed by the non-ejecting nozzles is printed by other nozzles, and the image is printed. In this embodiment, the density correction process for areas where interpolation processing is performed where the printing data to be printed by non-ejecting nozzles is printed by other nozzles is performed by using a different change amount table and correction table than for areas where this interpolation processing is not performed.

Figure 22:
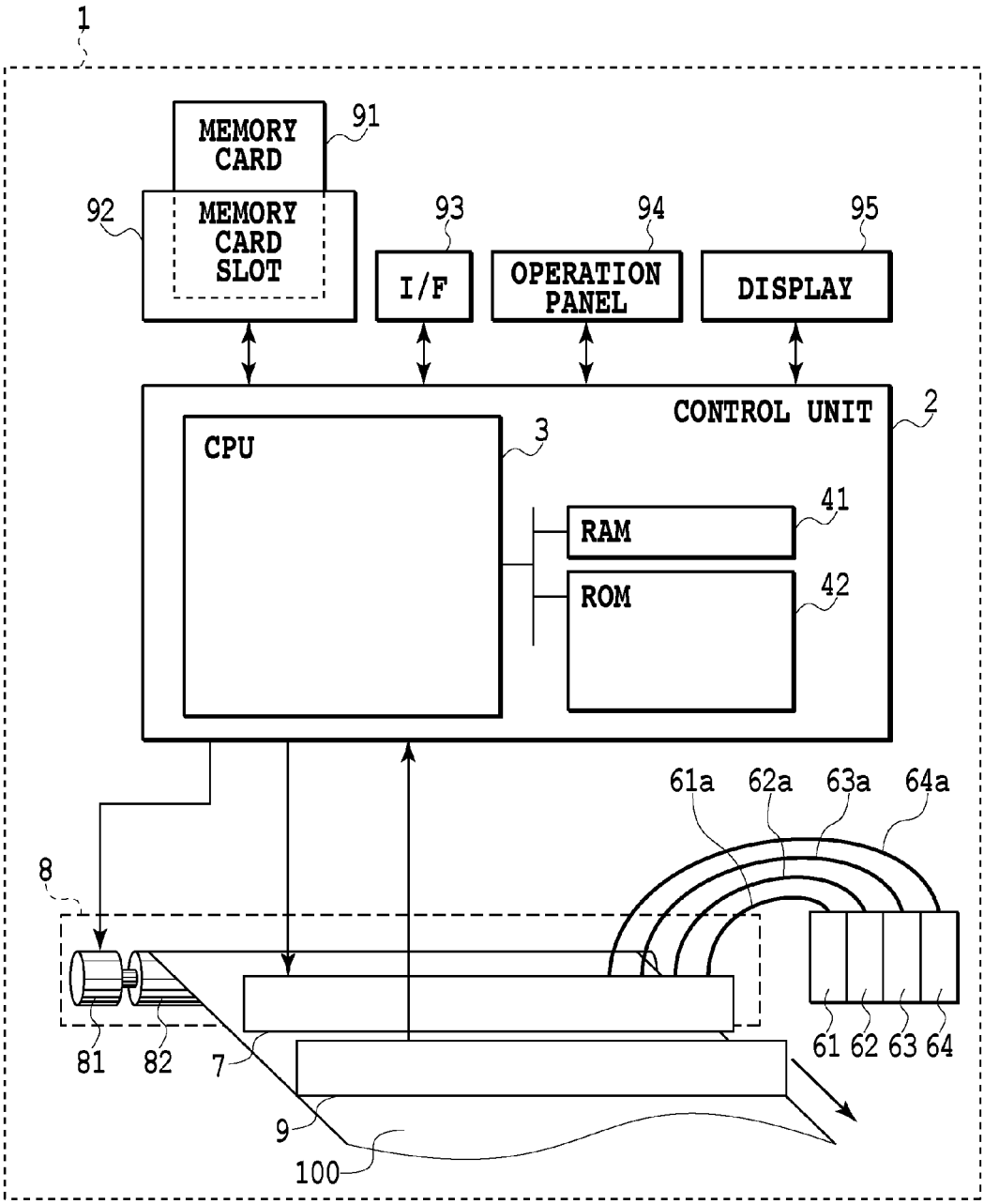
FIG. 22 is an explanative drawing illustrating an inkjet printing apparatus of a fifth embodiment.

FIG. 22 is an explanative drawing illustrating an inkjet printing apparatus of this embodiment. The printing apparatus of this embodiment is basically the same as the printing apparatus that was explained using FIG. 1 in the first embodiment. However, the printing apparatus of this embodiment comprises a scanner 9 that is located downstream in the conveying direction of the printing medium and that reads the printing results over a width that is wider than the printing width. Moreover, the printing apparatus of this embodiment is a printing apparatus that performs a detection process for detecting non-ejecting nozzles and a non-ejecting interpolation process.

Figure 23:
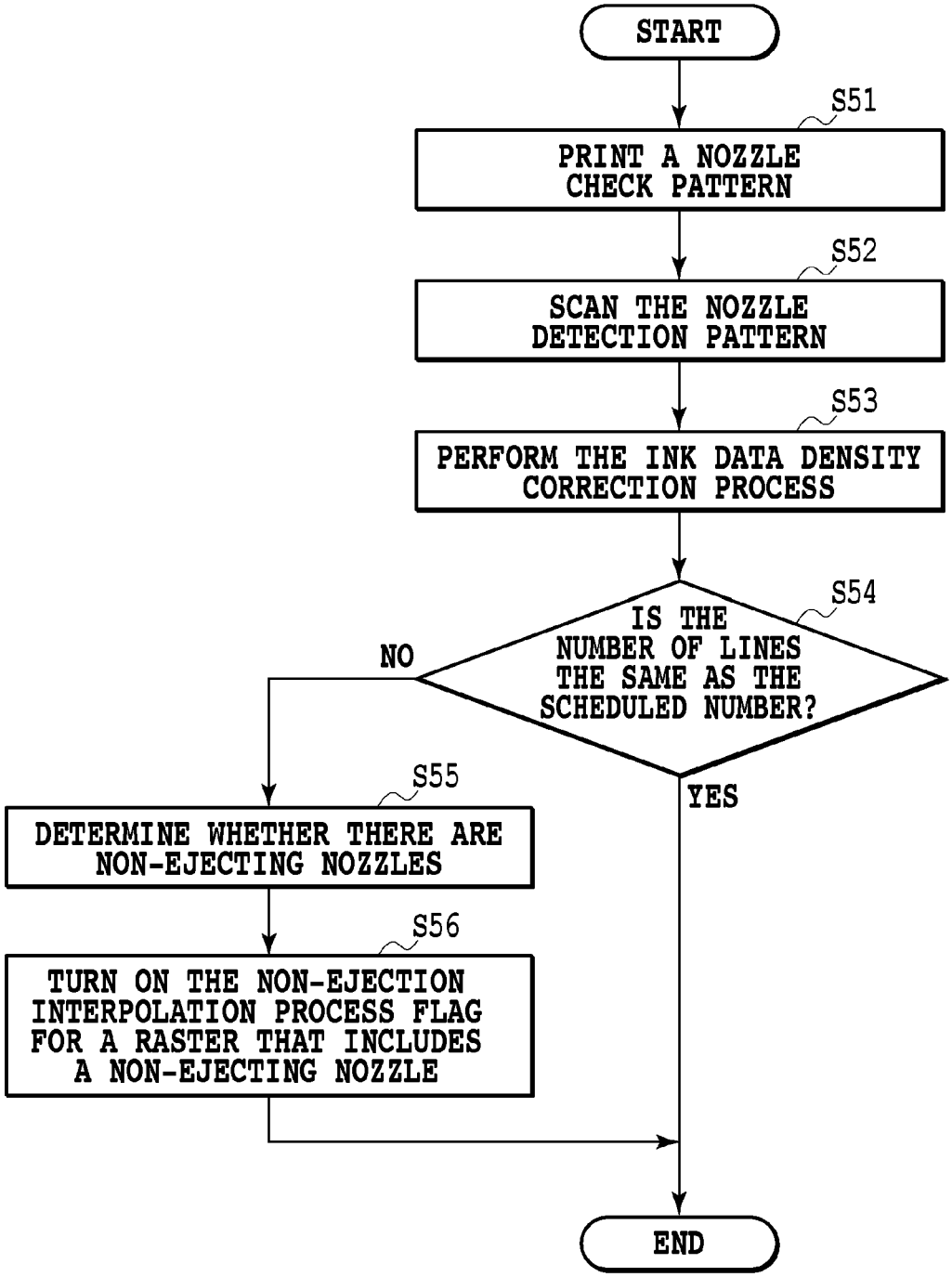
FIG. 23 is a flowchart illustrating the flow of a nozzle detection process of a fifth embodiment.

FIG. 23 is a flowchart illustrating the flow of the non-ejecting nozzle detection process of this embodiment. In this embodiment, detection of non-ejecting nozzles is performed for each image.

First, a non-ejecting nozzle detection pattern is printed for each image (step S51).

Figure 24A:
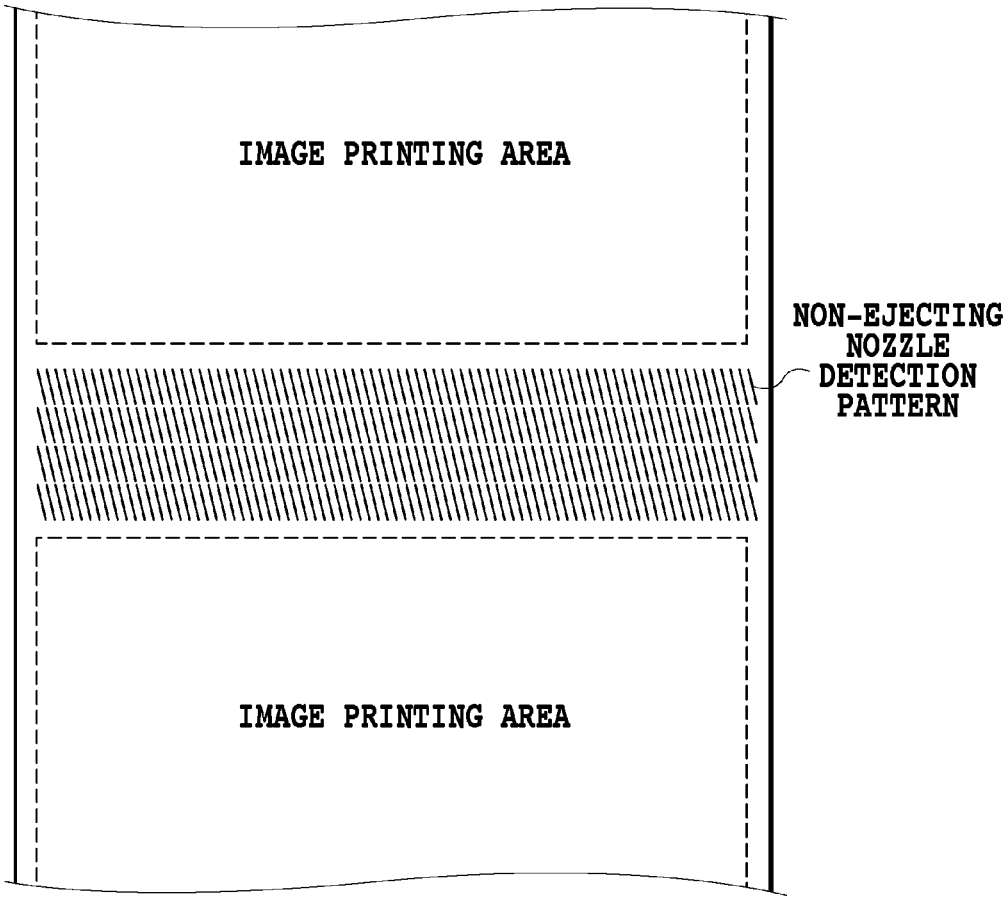
FIG. 24A and FIG. 24B are explanative drawings illustrating examples of a non-ejecting nozzle detection pattern of a fifth embodiment.
Figure 24B:
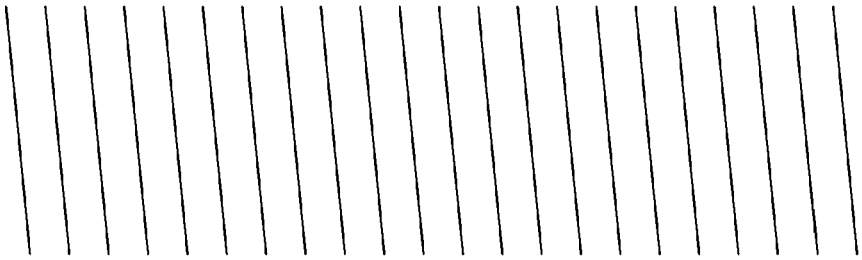

FIG. 24A and FIG. 24B are explanative drawings that illustrate an example of a non-ejecting nozzle detection pattern in this embodiment. FIG. 24A illustrates a non-ejecting nozzle detection pattern, and FIG. 24B is an enlarged drawing of part of the detection pattern illustrated in FIG. 24A. As illustrated in the figures, the non-ejecting nozzle detection pattern is read by the scanner 9, and is used to detect non-ejecting nozzles by identifying the locations where lines are missing.

Next, the non-ejection interpolation process of this embodiment will be explained. For example, when there is one non-ejecting nozzle, distribution is changed so that the dots that were supposed to be printed by the non-ejecting nozzle are printed in order by the other three nozzles in the same array. For example, when printing the solid image of Level 1, the order of nozzle use in a raster is 1-odd, 1-even, 2-odd, 2-even, 3-odd, 3-even, 4-odd, 4-even, repeated in that order. Here, 1-odd indicates the odd nozzles in the first nozzle array. When there was a non-ejecting nozzle in the 2-odd nozzles, the order of nozzle use becomes 1-odd, 1-even, 1-odd, 2-even, 3-odd, 3-even, 4-odd, 4-even, 1-odd, 1-even, 3-odd, 2-even, 3-odd, 3-even, 4-odd, 4-even, 1-odd, 1-even, 4-odd, 2-even, 3-odd, 3-even, 4-odd, 4-even, repeated in that order.

The flow of the image density correction process of this embodiment is the same as the flow of the image density correction process explained for the fourth embodiment using FIG. 19. However, the table selection process and the method for constructing the change amount table and correction table differ, so those differences will be explained below.

The table selection process of this embodiment changes the change amount table depending on whether or not the raster is a raster for which the non-ejection interpolation process is performed. This is because in this embodiment, in the case of a raster for which the non-ejection interpolation process is performed, the amount of change of the average integrated value of the used nozzles changes greatly due to the decrease in the number of nozzles that are used for dot formation. The dot arrangement is the same, so that in this embodiment, the same table is used as the correction table even though in this embodiment the non-ejection interpolation process is performed.

Figure 25:
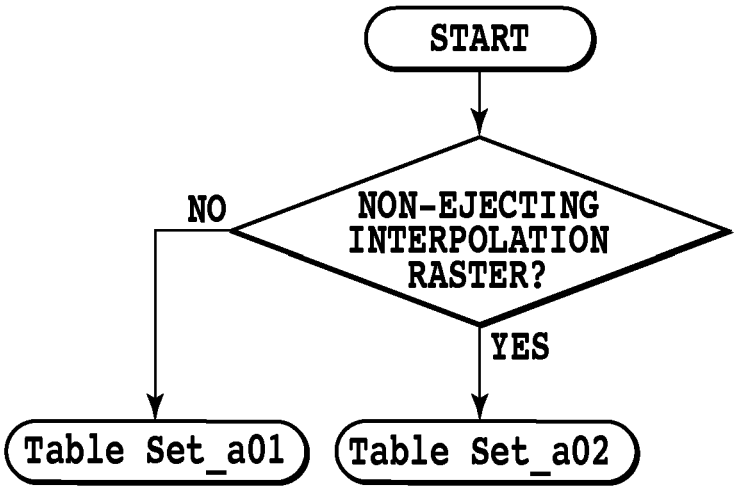
FIG. 25 is a flowchart illustrating the flow of a table selection process of a fifth embodiment.

FIG. 25 is a flowchart illustrating the flow of the table selection process of this embodiment. First, whether the target raster belongs to a connecting section or a non-connecting section is determined, and then the table set of the change amount table and correction table to be used is set.

FIG. 21B is a diagram illustrating the selection table of this embodiment. In this embodiment, the calculation method for the change amount table for a raster for which the non-ejection interpolation process is performed is different than the calculation method for the change amount table for a raster for which the non-ejection interpolation process is not performed, and is a method of calculating the average integrated value according to the difference in the number of nozzles that are used in dot formation of one raster.

First, a uniform solid image is prepared for each ink data. Then, the quantization that is used in this embodiment is performed in order to set the dot arrangement. The amount of change of the average integrated value is calculated by presuming that the nozzles that can be used are equally used in dot formation. The integrated value is calculated by adding a integrated value +10 for the waiting time when advancing one pixel, and the integrated value for the remaining concentration after dot formation is calculated by referencing the dashed line in FIG. 8A. All of the integrated values are calculated and the average value for each column is found, and that average value is taken to be the average integrated value. The amount of change corresponding to this average integrated value and the ink data is set by taking the difference between this average integrated value and that of the adjacent pixels for each pixel. This amount of change is found for each ink data, and the change amount table is created.

The correction table for the connecting sections is found in the same way as the density correction table in the first embodiment. Explanation will be omitted.

Embodiment 6

There are variations in the nozzle shapes among ejection substrates that are arranged in a printing head due to manufacturing, and due to these variations, the variations in concentration speed of ink around the nozzles is multiplied, so in this embodiment, the correction process is performed by using change amount tables that differ for each ejection substrate.

The construction of the printing apparatus of this embodiment is basically the same as the printing apparatus of the first embodiment. However, the printing head that is mounted in the printing apparatus of this embodiment is a thermal inkjet printing head. This printing head is heated by applying a pulse voltage to a heater near the nozzles, which creates bubbles, and the ink that is pressed outside of a nozzle by the volume expansion of the bubbles becomes an ink drop and is ejected. This printing head has the characteristic that the ejected ink drops change according to the width of the pulse voltage that is applied. The width of the pulse voltage that is applied to the nozzle heater is appropriately adjusted for each ejection substrate, and control is performed to reduce the change in voltage among ejection substrates. The data related to the adjustment of the width of the pulse voltage of each chip is stored in the printing head, and the printing apparatus references that data in order to perform optimal adjustment control. Moreover, it is presumed that there are ejection substrates in the printing head of this embodiment whose nozzles have different diameters due to variations in manufacturing.

The flow of the image processing and image density correction process of this embodiment are the same as the image density correction process of the fourth embodiment, and the flow of each is the same as that of the flowcharts illustrated in FIG. 18 and FIG. 19. However, in this embodiment, the table selection process, change amount table and correction table used in the image density correction process are different. Therefore, only these will be explained below.

FIG. 21C illustrates the selection table of this embodiment. As was described above, there are ejection substrates whose nozzles have different nozzle diameters due to variation in manufacturing of the printing head. When the nozzle diameters differ, the integrated value–concentration factor profile differs, so the change amount tables also differ. In regards to the correction table, in this embodiment, the ejection amount is adjusted by controlling the width of the pulse voltage even though the nozzle diameter changes, so the dot diameter is about the same, and therefore the same table is used. In the table selection process of this embodiment, therefore, a table set corresponding to the nozzles of the ejection substrates for each raster is selected and referenced.

The change table of this embodiment is found by the same method as the change amount table of the first embodiment. In order to create a change amount table that corresponds to each nozzle diameter, the amount of change is calculated by referencing an integrated value–concentration factor profile that corresponds to each respective nozzle diameter and finding the average integrated value.

The correction table is found in the same way as the density correction table of the first embodiment, so an explanation is omitted here.

Embodiment 7

The printing apparatus of this embodiment is the same as the printing apparatus of the first embodiment except for the construction of the nozzles of the printing head. In the nozzle construction of the printing head of this embodiments, the number of arrays and the nozzle arrangement are the same as in the first embodiment, however, two arrays (arrays A and C) of the four arrays have nozzles having a large nozzle diameter, and the other two arrays (arrays B and D) have nozzles having a small nozzle diameter. The ejection amounts from these nozzles of different size are taken to be 5p1 and 7p1, respectively. Moreover, in the printing apparatus of this embodiment, in order to eliminate the difference in concentration due to differences in nozzle diameters or differences in ejection amounts caused by variations in manufacturing of the ejection substrates of the printing head, printing is performed by changing the usage ration of large and small nozzles so that the average ejection amount is about the same for the same gradation. The data for the usage ratio of the large and small nozzles is stored in the ROM of the printing head (not illustrated in the figures), and the printing apparatus performs processing by referencing that data.

In the printing apparatus of this embodiment, the printing pixels are 600 dpi. The printing pixels comprise two columns that have a width of 1200 dpi, with one column being a column to print dots using large nozzles, and the other column being a column that prints dots with small nozzles. When the ejection amounts of the large and small nozzles are design values, the usage ratio for both the large and small nozzles is 50%.

FIG. 26 is a table that illustrates combinations of usage ratios when the actual ejection amounts of the large and small nozzles of this embodiment differ from the design values.

Figure 27:
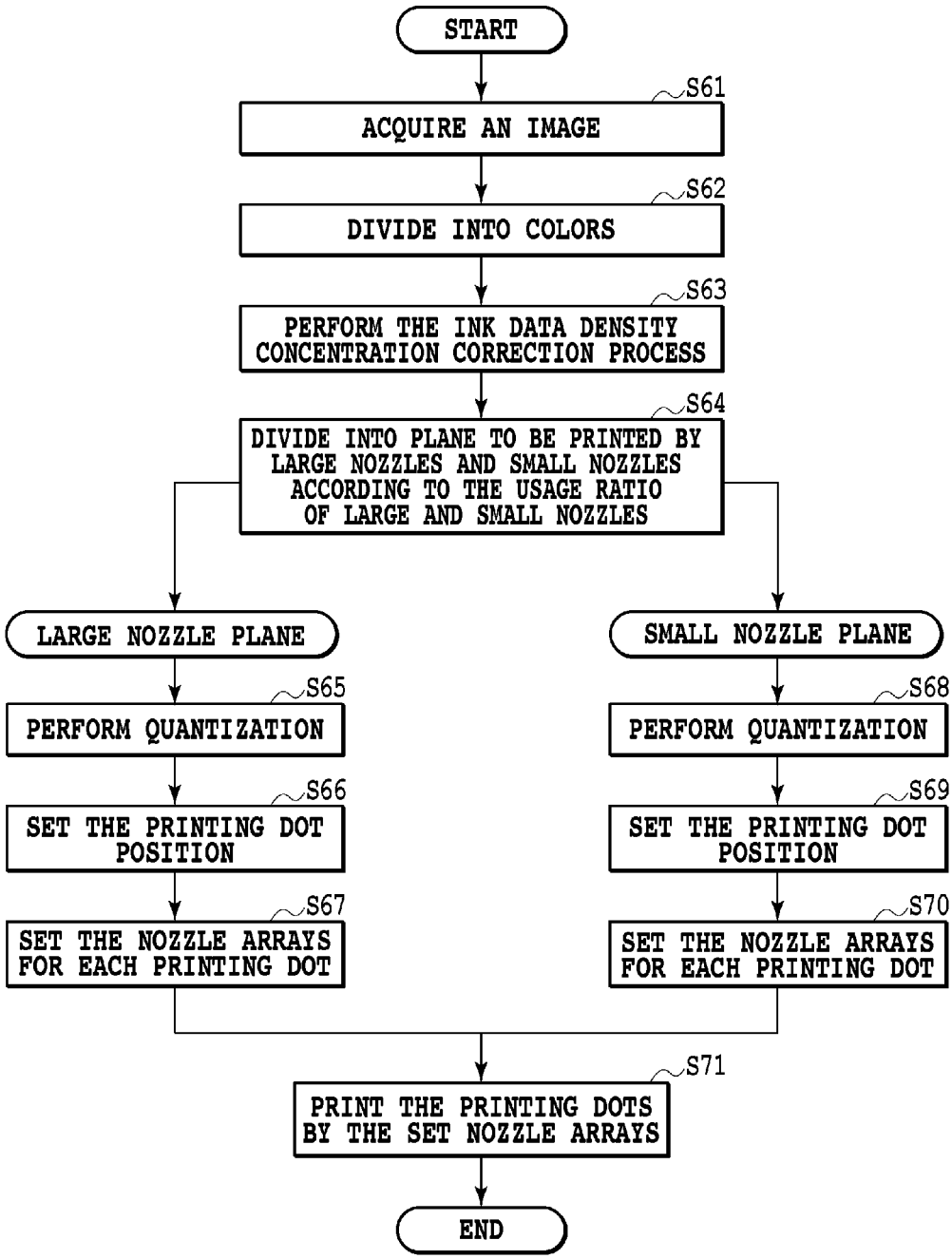
FIG. 27 is a flowchart illustrating the flow of image processing of a seventh embodiment.

FIG. 27 is a flowchart illustrating the flow of the image-processing unit of this embodiment. After the image is acquired (step S61), the image data is divided according to color (step S62) and the ink data density correction process has been performed (step S63), the corrected multi-value image is divided into an image to be printed by the large and small nozzles (step S64). The gradation values of each pixel of each respective image are values obtained by multiplying the gradation values of each pixel of the density corrected images with the usage ratios for the large and small nozzles. After dividing the image into images for the large and small nozzles, quantization is performed for each respective image (step S65 and step S68), the printing dot arrangement is set (step S66 and step S69) and the nozzle arrays for each printing dot are set (step S67 and step S70). Then, the printing dots are printed by each of the set nozzle arrays (step S71).

Figure 28:
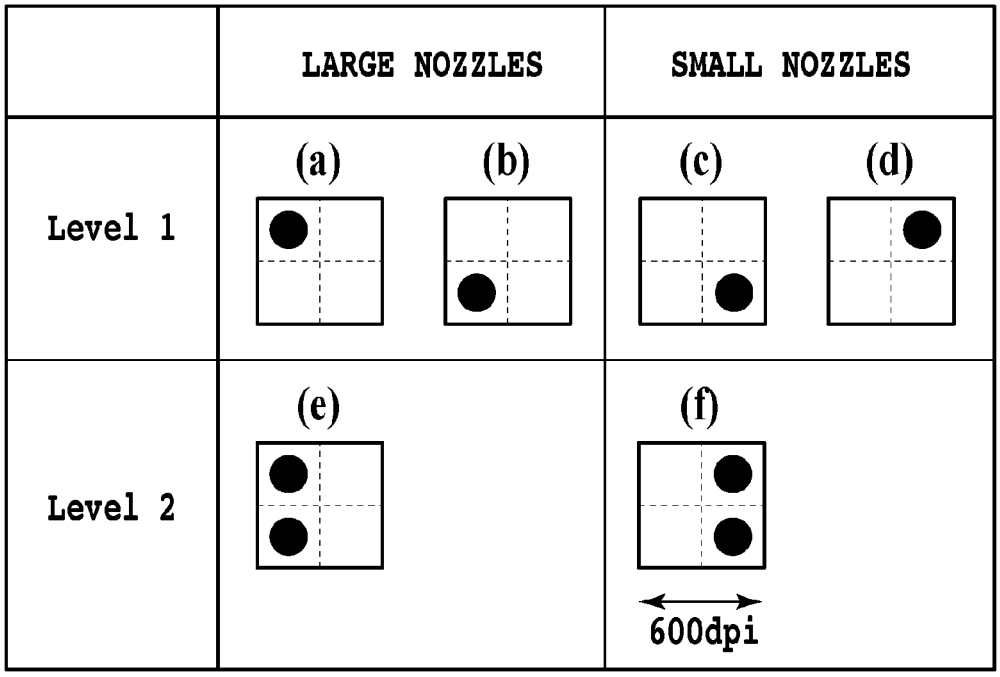
FIG. 28 is a schematic diagram illustrating the dot positions inside a pixel of a seventh embodiment.

FIG. 28 is a schematic diagram illustrating the dot positions in a pixel according to Level 1 of the dot arrangement positions of this embodiment. The printing pixels are 600 dpi, and for the large and small nozzles, the quantized image data having the values of the three levels 0 to 2 are indicated by dot patterns having a printing dot resolution of 1200 dpi. For example, when the result of quantization of the large nozzles is Level 1, one dot is printed in the 600 dpi printing pixels, and for the printing positions of the dots, the two patterns, upper left ((a) in FIG. 28) and lower left ((b) in FIG. 28) are repeated. After the printing positions of the dots have been set, the dot data is distributed to each of the nozzle arrays.

The flow of the image density correction process of this embodiment is the same as the flow of the image density correction process of the fourth embodiment explained using FIG. 19. However, the table selection process, and the method for constructing the change amount table and correction table are different, so these differences will be explained below.

In the table selection process of this embodiment there is a difference in the ejection amount by each chip, and accompanying that, there is a difference in the usage ratio of the large and small nozzles, so as in the fourth embodiment, the density correction process is performed by using different change amount tables and correction tables for each chip. The change amount table is changed for each chip because the nozzle diameters and concentration speeds differ for each ejection substrate, and the frequency of usage differs according to the usage ratios of large and small nozzles.

FIG. 21D is a diagram illustrating a selection table of this embodiment. The change amount table of this embodiment is used to prepare uniform solid image data for each ink data. Then, the image is divided into images fort the large and small nozzles that are used in this embodiment, quantization is performed, and the dot arrangement is set. The amount of change of the average integrated value is calculated by presuming that the nozzles of each of the large and small nozzle arrays are equally used in dot formation. An integrated value of +10 is added to the integrated value for the wait time each time the process advances one pixel.

Figure 29:
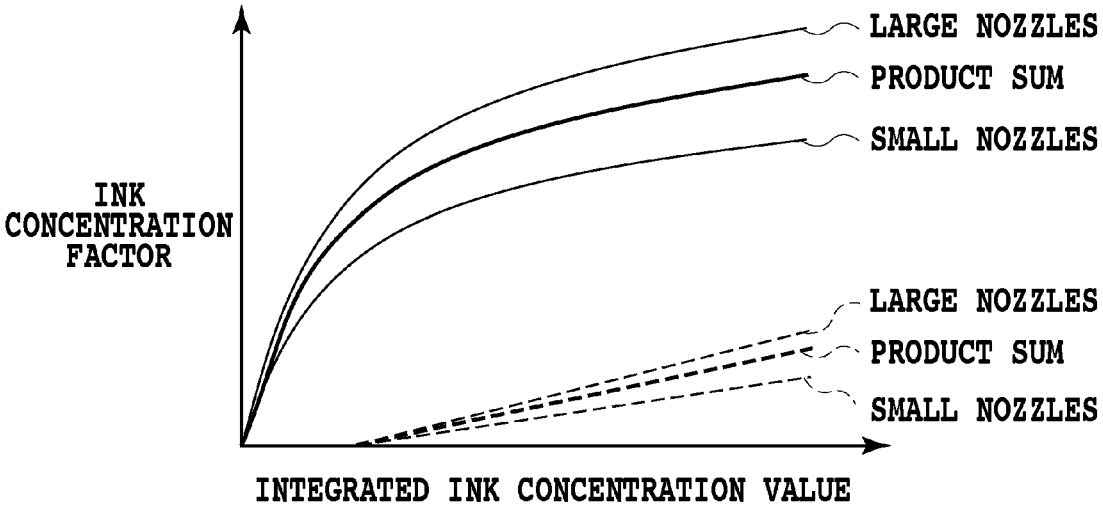
FIG. 29 is a graph illustrating the relationship between the ink concentration factor and integrated concentration value of a seventh embodiment.

FIG. 29 is a graph illustrating the relationship between the concentration factor of the ink of large and small nozzles and the integrated ink concentration value. The concentration profile of large and small nozzles indicated by the solid lines, which are the integrated sum of the respective usage ratios are calculated based on the concentration profile of values of the product sums indicated by the bold line. Moreover, the integrated values of the remaining concentration after dot formation are calculated from the product sums indicated by the bold dashed line. All of the integrated values are calculated and the average value of combined large and small dots for each column is found and taken to be the average integrated value. The amount of change corresponding to the average integrated value and the ink data is set by taking the difference between this average integrated value and that of the adjacent pixels for each pixel. This is found for each ink data, and the change amount table is created.

The correction table of this embodiment is created for the usage ratios of each of the large and small nozzles by using the same method as the correction table of the first embodiment.

Other Embodiments

In the embodiments above, as illustrated in FIG. 11 and FIG. 19, in the density correction process, the amount of change in integrated values was found by referencing ink data of selected pixels after correction. However, in the present invention, the order of correcting ink data, calculating the amount of change in integrated values and calculating integrated values can be changed from the order of the steps illustrated in the flowcharts as long as the correction process is performed suitably.

Figure 30A:
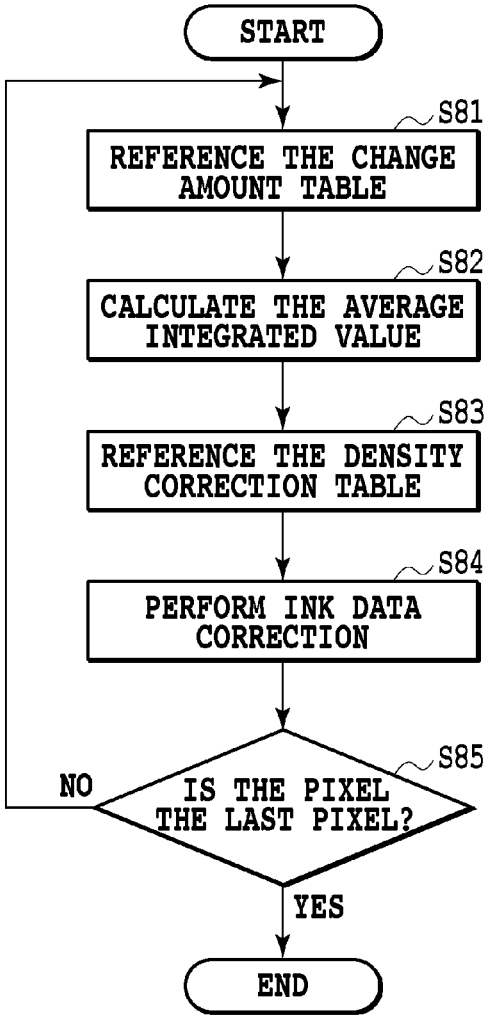
FIG. 30A and FIG. 30B are flowcharts illustrating the flow of a correction process of other embodiments.

FIG. 30A is a flowchart illustrating the correction process of other embodiments.

Figure 30B:
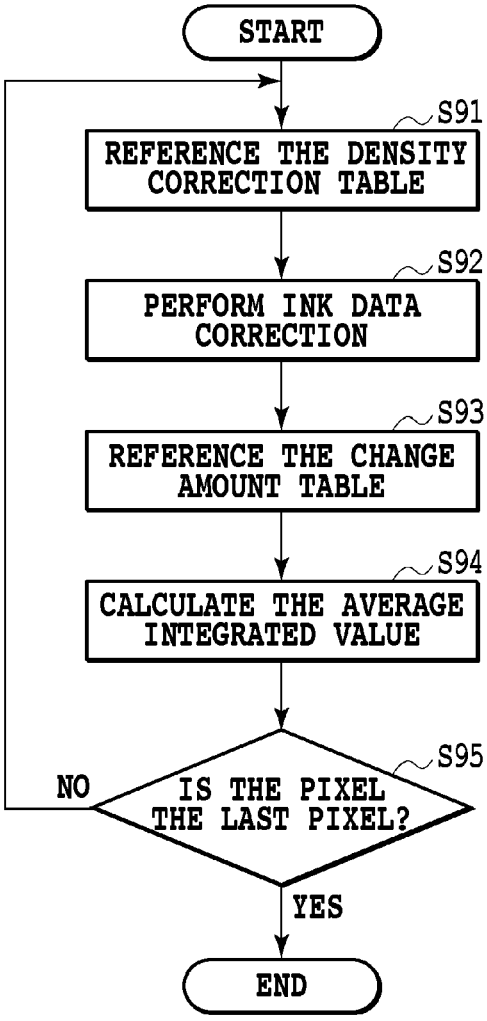

FIG. 30B is a flowchart illustrating the ink data density correction process.

Instead of the flowchart illustrated in FIG. 11, it is possible to use a flowchart as illustrated in FIG. 30A to reference the ink data one before the selected pixel before correction in order to calculate the amount of change of the integrated value and calculate the integrated value. Moreover, instead of the flowchart illustrated in FIG. 19, it is possible to use the order illustrated in FIG. 30B of calculating the amount of change and calculating the integrated value after correction is finished.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-105240 filed on May 10, 2011, No. 2012-068973 filed on Mar. 26, 2012, and No. 2012-101527 filed on Apr. 26, 2012, which are hereby incorporated by reference herein in their entirety.

What is claimed is:

1. An image processing apparatus for printing images on a printing medium by relative scanning between the printing medium and a printing head comprising a plurality of nozzles to eject ink, the apparatus comprising:

an acquisition unit configured to acquire both of multi-value image data that is to be printed to a first pixel on the printing medium by using predetermined nozzles, and a first parameter that indicates a degree of concentration of ink in the predetermined nozzles when the predetermined nozzles eject ink to the first pixel;

a generation unit configured to generate (i) corrected data by correcting the multi-value image data based on the first parameter and the multi-value image data; and (ii) a second parameter that indicates the degree of concentration of ink in the predetermined nozzles when the predetermined nozzles eject ink to a second pixel that is printed next to the first pixel on the printing medium, based on the first parameter and the corrected data, wherein the generation unit generates the corrected data such that a difference between the corrected data and the multi-value image data in a case where the degree indicated by the first parameter is a first degree is larger than a difference between the corrected data and the multi-value image data in a case where the degree indicated by the first parameter is a second degree which is lower than the first degree.

2. The image processing apparatus according to claim 1, wherein the first generation unit generates the corrected data by determining a correction value based on the first parameter and the multi-value image data, and correcting the multi-value image data by using that correction value.

3. The image processing apparatus according to claim 2, wherein in the first generation unit, the correction value that is generated in a case where the degree indicated by the first parameter is the first degree, is greater than the correction value that is generated in a case where the degree indicated by the first parameter is the second degree.

4. The image processing apparatus according to claim 1, wherein the second pixel is adjacent to the first pixel.

5. The image processing apparatus according to claim 1, wherein the predetermined nozzles eject ink to the first pixel and eject ink to the second pixel by a single relative scanning.

6. The image processing apparatus according to claim 1, further comprising a unit for driving the print head based on the corrected data generated by the first generation unit so as to eject ink to the first pixel.

7. The image processing apparatus according to claim 1, wherein the acquisition unit acquires second multi-value image data that is to be printed to the second pixel, and the generation unit generates (i) second corrected data based on the second multi-value data and the second parameter, and (ii) a third parameter based on the second corrected data and the second parameter, wherein the third parameter indicates the degree of concentration of ink in the predetermined nozzles when the predetermined nozzles eject ink to a third pixel that is printed next to the second pixel on the printing medium.

8. The image processing apparatus according to claim 1, wherein the first parameter is an average value of parameters indicating the degree of concentration of ink in each of the predetermined nozzles.

9. The image processing apparatus according to claim 1, wherein the printing head includes a plurality of nozzle arrays that eject the same color of ink in the direction of the relative scanning, and the predetermined nozzles include some nozzles in each of the plurality of nozzle arrays.

10. The image processing apparatus according to claim 1, wherein the generation unit generates the second parameter such that the second parameter in a case where a value of the corrected data is a first value is smaller than the second parameter in a case where a value of the corrected data is a second value which is smaller than the first value.

11. The image processing apparatus according to claim 1, wherein the acquisition unit acquires second multi-value image data that is to be printed to the second pixel, and the generation unit generates (i) second corrected data based on the second multi-value data and the second parameter, and (ii) a third parameter based on the second corrected data and the second parameter, wherein the third parameter indicates the degree of concentration of ink in the predetermined nozzles when the predetermined nozzles eject ink to a third pixel that is printed next to the second pixel on the printing medium.

12. An image processing method for printing images on a printing medium by relative scanning between the printing medium and a printing head comprising a plurality of nozzles to eject ink, the method comprising the steps of:

acquiring both of multi-value image data that is to be printed to a first pixel on the printing medium by using predetermined nozzles, and a first parameter that indicates a degree of concentration of ink in the predetermined nozzles when the predetermined nozzles eject ink to the first pixel;

generating (i) corrected data by correcting the multi-value image data based on the first parameter and the multi-value image data; and (ii) a second parameter that indicates the degree of concentration of ink in the predetermined nozzles when the predetermined nozzles eject ink to a second pixel that is printed next to the first pixel on the printing medium, based on the first parameter and the corrected data, wherein in the step of generating, the corrected data are generated such that a difference between the corrected data and the multi-value image data in a case where the degree indicated by the first parameter is a first degree is larger than a difference between the corrected data and the multi-value image data in a case where the degree indicated by the first parameter is a second degree which is lower than the first degree.

13. An image processing apparatus for printing images on a printing medium by relative scanning between the printing medium and a printing head comprising a plurality of nozzles to eject ink, the apparatus comprising:

an acquisition unit configured to acquire both of multi-value image data that is to be printed to a first pixel on the printing medium by using predetermined nozzles, and a first parameter that indicates a degree of concentration of ink in the predetermined nozzles when the predetermined nozzles eject ink to the first pixel;

a generation unit configured to generate (i) corrected data by correcting the multi-value image data based on the first parameter and the multi-value image data; and (ii) a second parameter that indicates the degree of concentration of ink in the predetermined nozzles when the predetermined nozzles eject ink to a second pixel that is printed next to the first pixel on the printing medium, based on the first parameter and the corrected data, wherein the predetermined nozzles eject ink to the first pixel and eject ink to the second pixel by a single relative scanning.

14. An image processing apparatus for printing images on a printing medium by relative scanning between the printing medium and a printing head comprising a plurality of nozzles to eject ink, the apparatus comprising:

an acquisition unit configured to acquire both of multi-value image data that is to be printed to a first pixel on the printing medium by using predetermined nozzles, and a first parameter which is an average value of parameters indicating the degree of concentration of ink in each of the predetermined nozzles when the predetermined nozzles eject ink to the first pixel a generation unit configured to generate (i) corrected data by correcting the multi-value image data based on the first parameter and the multi-value image data; and (ii) a second parameter that indicates the degree of concentration of ink in the predetermined nozzles when the predetermined nozzles eject ink to a second pixel that is printed next to the first pixel on the printing medium, based on the first parameter and the corrected data.

15. An image processing apparatus for printing images on a printing medium by relative scanning between the printing medium and a printing head comprising a plurality of nozzles to eject ink, the apparatus comprising:

an acquisition unit configured to acquire both of multi-value image data that is to be printed to a first pixel on the printing medium by using predetermined nozzles, and a first parameter that indicates a degree of concentration of ink in the predetermined nozzles when the predetermined nozzles eject ink to the first pixel;

a generation unit configured to generate (i) corrected data by correcting the multi-value image data based on the first parameter and the multi-value image data; and (ii) a second parameter that indicates the degree of concentration of ink in the predetermined nozzles when the predetermined nozzles eject ink to a second pixel that is printed next to the first pixel on the printing medium, based on the first parameter and the corrected data, wherein the generation unit generates the second parameter such that the second parameter in a case where a value of the corrected data is a first value is smaller than the second parameter in a case where a value of the corrected data is a second value which is smaller than the first value.

16. The image processing apparatus according to claim 15, wherein the generation unit generates the second parameter by determining an adjustment parameter based on the first parameter and corrected data, and adjusting the first parameter by using the adjustment parameter.

17. The image processing apparatus according to claim 16, wherein the generation unit determines the adjustment parameter such that the adjustment parameter in a case where a value of the corrected data is the first value is smaller than the adjustment parameter in a case where a value of the corrected data is the second value.

18. The image processing apparatus according to claim 17, wherein the generation unit determines the adjustment parameter to negative value in a case where a value of the corrected data is the first value and to positive value in a case where a value of the corrected data is the second value.

19. The image processing apparatus according to claim 17, wherein the generation unit determines the adjustment parameter to positive value in a case where a value of the corrected data is the second value regardless of the first parameter.

20. The image processing apparatus according to claim 15, wherein the generation unit generates the corrected data such that a difference between the corrected data and the multi-value image data in a case where the degree indicated by the first parameter is a first degree is larger than a difference between the corrected data and the multi-value image data in a case where the degree indicated by the first parameter is a second degree which is lower than the first degree.

21. The image processing apparatus according to claim 15, further comprising a unit for driving the print head based on the corrected data generated by the first generation unit so as to eject ink to the first pixel.

22. An image processing method for printing images on a printing medium by relative scanning between the printing medium and a printing head comprising a plurality of nozzles to eject ink; the method comprising the steps of:

acquiring both of multi-value image data that is to be printed to a first pixel on the printing medium by using predetermined nozzles, and a first parameter that indicates a degree of concentration of ink in the predetermined nozzles when the predetermined nozzles eject ink to the first pixel;

generating (i) corrected data by correcting the multi-value image data based on the first parameter and the multi-value image data; and (ii) a second parameter that indicates the degree of concentration of ink in the predetermined nozzles when the predetermined nozzles eject ink to a second pixel that is printed next to the first pixel on the printing medium, based on the first parameter and the corrected data, wherein in the step of generating, the second parameter is generated such that the second parameter in a case where a value of the corrected data is a first value is smaller than the second parameter in a case where a value of the corrected data is a second value which is smaller than the first value.

* * * * *